US006154131A

United States Patent [19]

Jones, II et al.

[11] Patent Number: 6,154,131

[45] Date of Patent: Nov. 28, 2000

[54] CASINO TABLE SENSOR ALARMS AND METHOD OF USING

[76] Inventors: Griffith Jones, II, 393 Grant St., Phillipsburg, N.J. 08865-3220; Griffith Jones, III, 53 Palmer St., Pawcatuck, Conn. 06379

[21] Appl. No.: 09/185,060

[22] Filed: Nov. 3, 1998

Related U.S. Application Data

[63] Continuation-in-part of application No. 08/763,767, Dec. 11, 1996, Pat. No. 5,831,527.

[51] Int. Cl.[7] ..... G08B 21/00

[52] U.S. Cl. ..... 340/540; 273/138.1; 273/148 R; 340/541; 340/556; 340/562; 340/573.1; 340/573.7

[58] Field of Search ..... 340/540, 541, 340/562, 556, 573.1, 573.7; 364/412; 273/138.1, 148 R

[56] References Cited

U.S. PATENT DOCUMENTS

| | | | |
|---|---|---|---|
| 4,755,941 | 7/1988 | Bacchi | 364/412 |
| 4,813,675 | 3/1989 | Greenwood | 463/46 |
| 5,283,422 | 2/1994 | Storch et al. | 235/375 |
| 5,299,803 | 4/1994 | Halaby | 273/148 R |
| 5,362,053 | 11/1994 | Miller | 273/148 R |
| 5,377,994 | 1/1995 | Jones | 273/309 |
| 5,406,264 | 4/1995 | Plonsky et al. | 340/572.1 |
| 5,518,249 | 5/1996 | Sines et al. | 273/304 |
| 5,521,616 | 5/1996 | Capper et al. | 345/156 |
| 5,831,527 | 11/1998 | Jones, II et al. | 340/540 |
| 5,957,776 | 9/1999 | Hoehne | 273/148 R |
| 5,961,121 | 10/1999 | Brown | 273/148 R |

*Primary Examiner*—Glen Swann
*Attorney, Agent, or Firm*—Charles A. Wilkinson

[57] ABSTRACT

A system of sensors to prevent cheating at a casino gaming table, where the sensors are strategically positioned about a casino gaming table to monitor the movement about certain established areas on the gaming table during certain established times during the play of the game. The tripping of a sensor in response to the detection of unauthorized movement about a certain area of the table sends a signal to a monitoring system which in turn alerts the casino so that the casino may respond to the unauthorized movement accordingly. The system of sensors can be used with a wide variety of card-based or chip-based casino gaming tables.

18 Claims, 14 Drawing Sheets

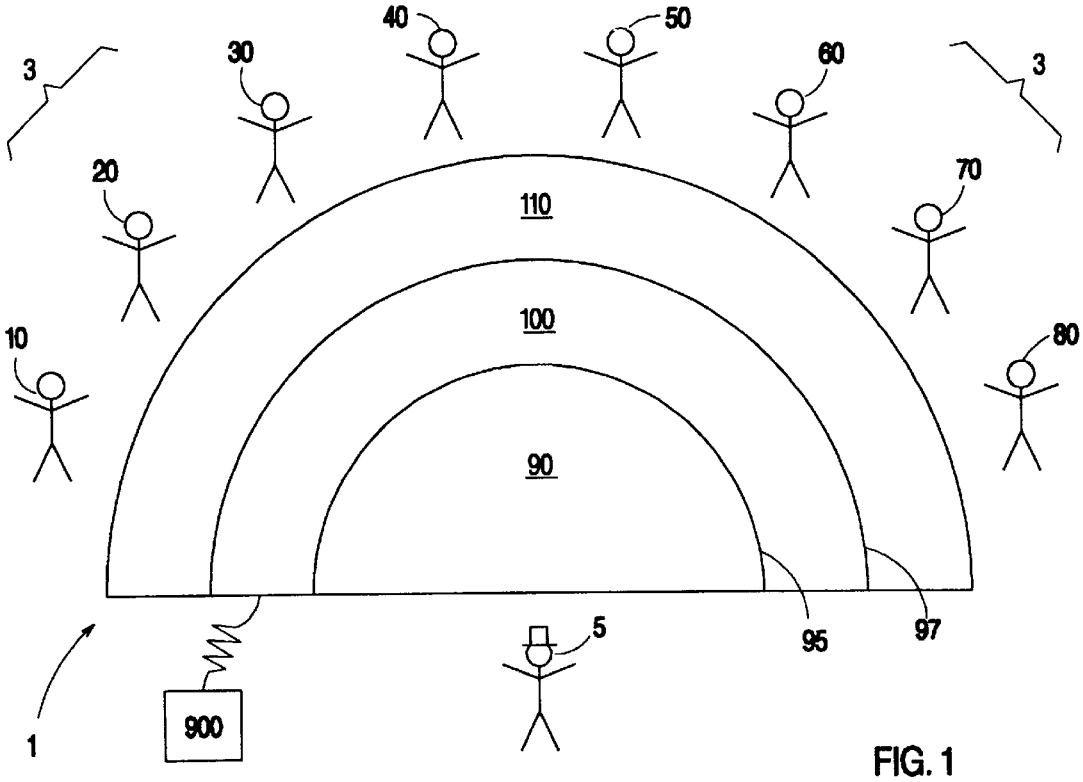
FIG. 1
FIG. 3
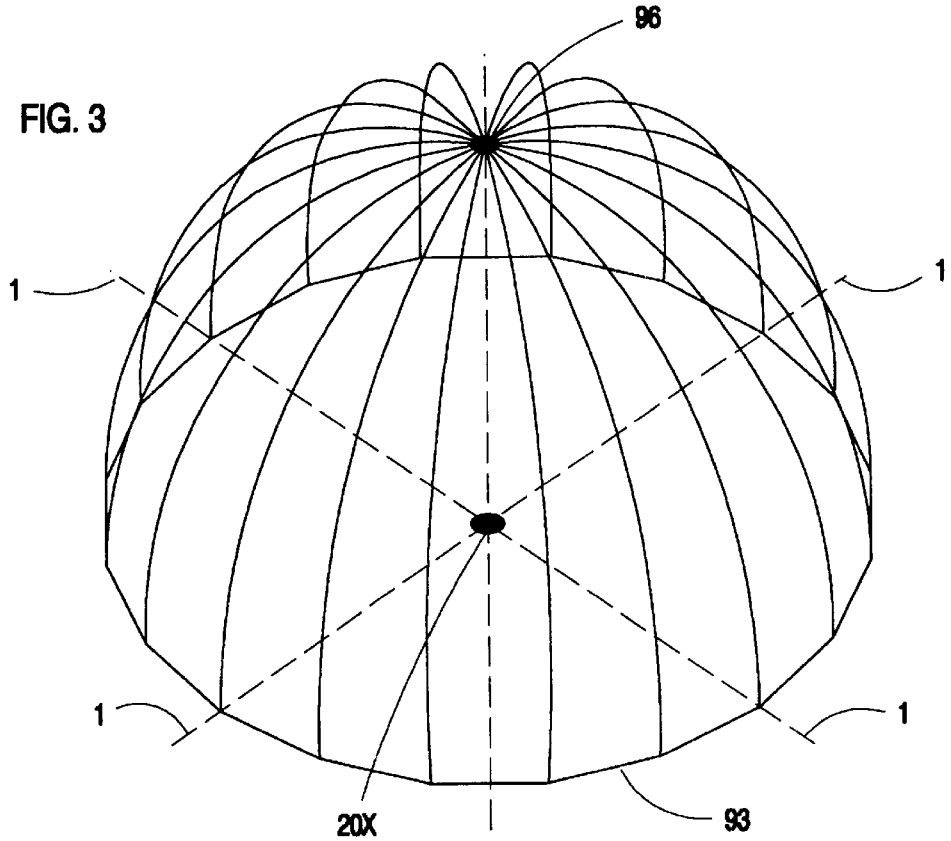

FIG. 4
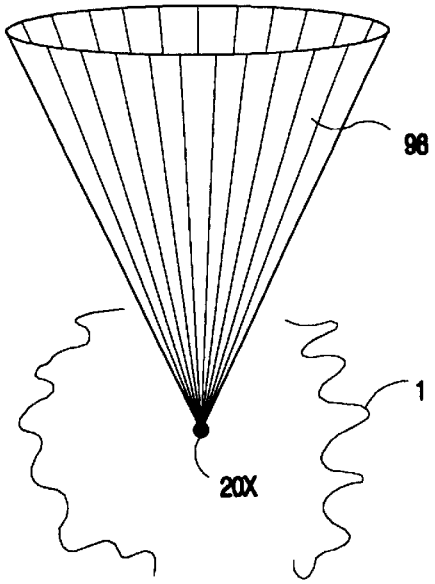
FIG. 4A
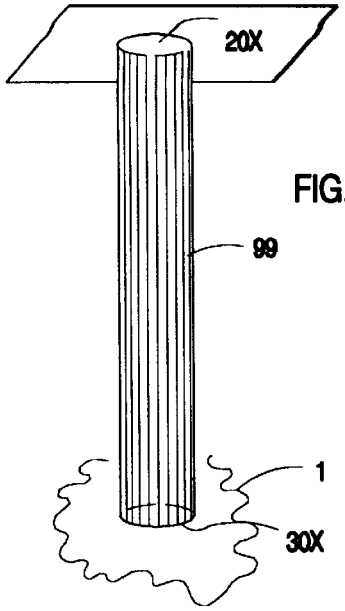
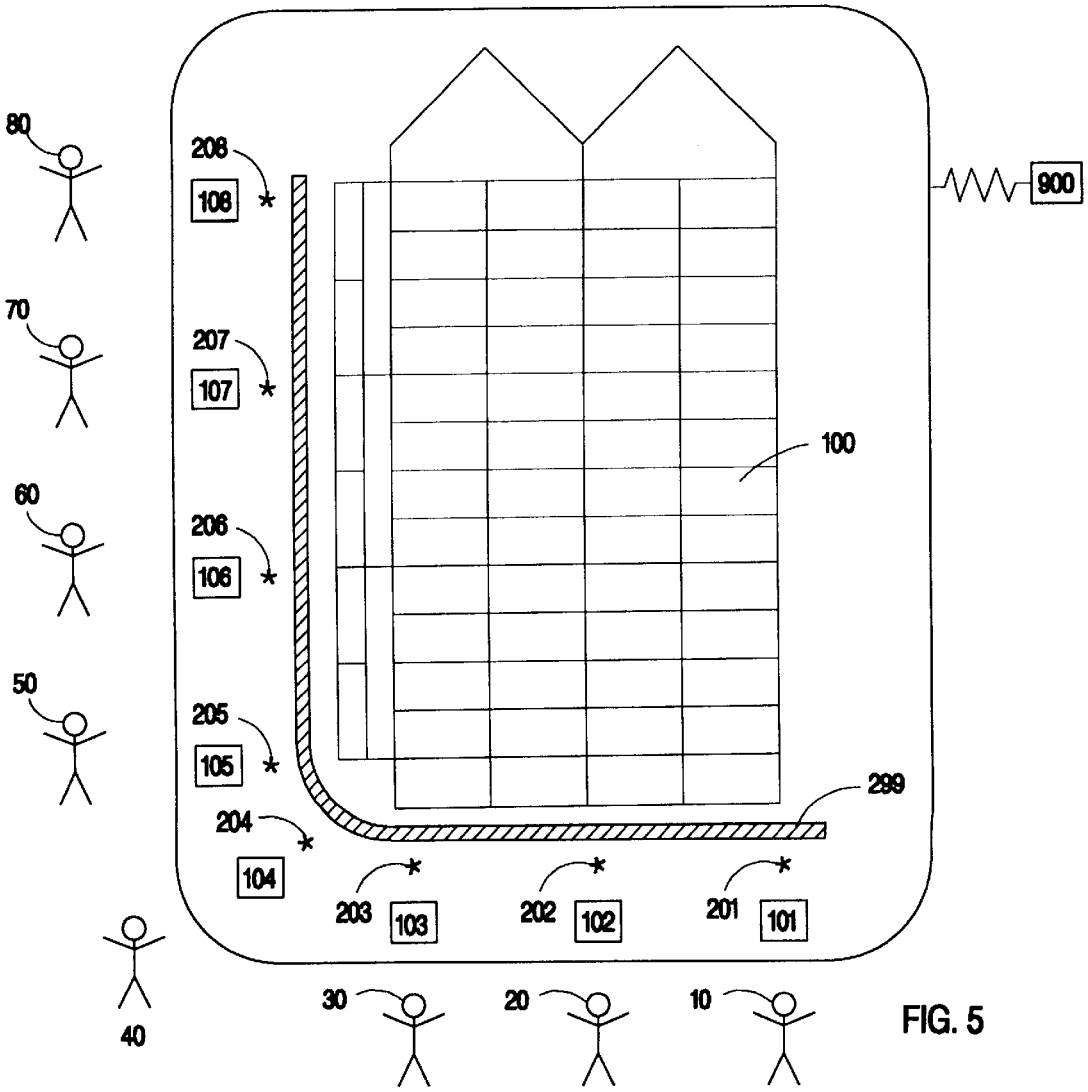
FIG. 5

FIG. 5A
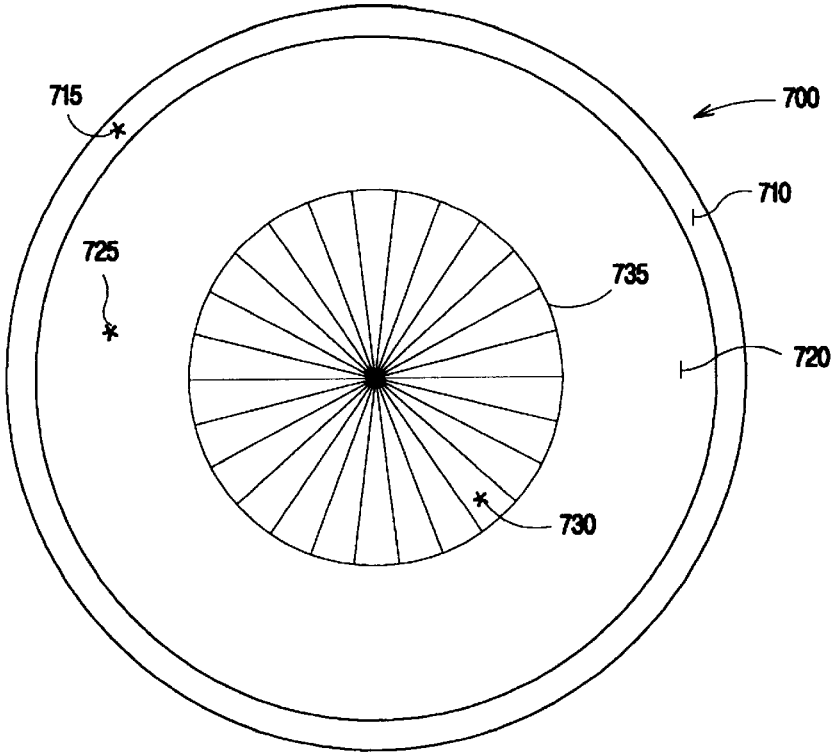
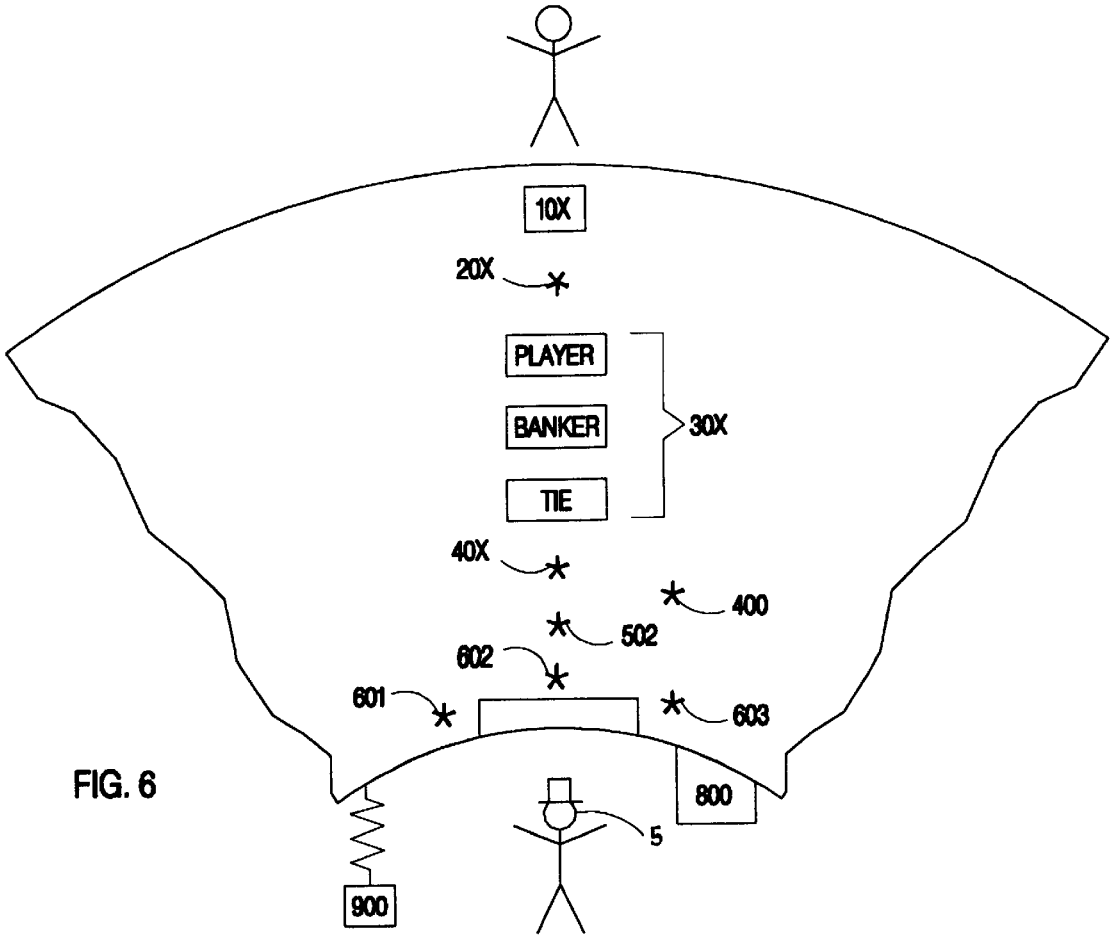
FIG. 6

X
X
DH CR
71
DH CR
C1
72
N1
73
DT1
C2
74
N2
75
DT2
C3
76
N3
77
DT3
C4
78
N4
79
DT4
C5
80
N5
81
DT5
C6
82
N6
83
DT6
C7
84
N7
85
DT7
C8
86
N8
87
DT8
P 1/11
P 1/8
TO ALL SENSORS

CASINO TABLE SENSOR ALARMS AND METHOD OF USING

CROSS-REFERENCES TO RELATED APPLICATIONS

This is a continuation-in-part of application Ser. No. 08/763,767 filed Dec. 11, 1996, now U.S. Pat. No. 5,831,527.

FIELD OF THE INVENTION

This invention relates generally to detection and monitoring systems for casino tables, and more particularly to devices which monitor the players's and dealer's movement of their hands and chips during the play of casino games.

BACKGROUND OF THE INVENTION

Casinos are multi-billion dollar industries. Even though legalized gambling is a relatively young industry in this country, developed only within the past twenty to fifty years, it continues to grow as the general social climate becomes more liberal. The rise of the independent Native American nations has resulted in additional recent growth of the casino industry, which can also be seen in riverboat, marine and other off-shore gambling.

Two elements are generally required for a casino to operate effectively. The first, and obvious element, is the monetarily endowed gambler. The chance to "make it big" is enough to attract almost anyone with some money burning in their pocket, other than perhaps the trained statistician and the born pessimist. The con-artist gambler, however, who manages to reverse the odds of winning by cheating and defeating the system, costs casinos millions of dollars each year in lost revenues, which ultimately results in decreased revenues to the state and community.

The second necessary element for an effective casino operation is an efficient casino management and security system. Hundreds of people in each casino are paid a substantial amount of money just to observe the gamblers, in addition to the thousands of dollars spent on electronic surveillance and the personnel who monitor such equipment. Dealers are schooled and trained in techniques which are supposed to be harmonized throughout the industry, focusing on the shuffle, card handling, and player association and relation. The interaction between the dealers and the gamblers is the most scrutinized, since hundreds of dollars can be exchanged in a single hand.

The dealer/player interaction is, for the most part, monitored by electronic surveillance and roving observers. Electronic surveillance usually takes the form of electronic camera globes which blanket the walls and ceilings of the casinos, and which appear to serve more of a deterrent purpose than a true constant surveillance function. For the most part, the cameras, or the monitoring personnel for such cameras, only monitor those tables which have been reported as containing observed questionable activity. Therefore, most of the time, any given table goes unmonitored. Part of the reason for this is that very close attention normally has to be paid to any given table to detect out of order occurrences, particularly considering the reduced scale images of the monitors, and it simply becomes too expensive to assign trained watchers to monitor each table even if they could observe it directly.

There are three potential problem areas that monitoring systems are supposed to alleviate. The first, and most obvious problem area, is the gambler who cheats without the aid of another human being. This person may surreptitiously and illegally increase or decrease his or her stakes during the play of the game, or surreptitiously and illegally move his or her wager from one part of the table to another after the fate of the game has been decided. The second, and not so obvious problem area, is the dealer who cheats without the aid of another human being. The dealer may clear the losing gamblers's chips from a table once the play has ended, and secretly divert a chip or two from the chip bin to his or her own pocket. The third problem area occurs when a dealer and a player act in concert to cheat the casino. This "symbiotic" relationship can be one of the most difficult to detect, since the outward manifestations and communications may not be as clear to a roving observer or hidden camera as would a gambler who physically moves a chip from one table location to another or a dealer who appropriates chips or the like.

The gambler who cheats by moving chips is usually the primary focus of security measures. Experienced cheaters have a way of maneuvering themselves in such a way as to avoid detection by any cameras or roving observers, usually by huddling over their positions with their backs to the cameras and their bodies over the playing area. Cheaters also use the placement of their cocktail drinks upon the casino table as an avenue to move chips. A chip, hidden in the hand used to grasp or pick up a drink from the table, is inconspicuously added to the cheater's betting pile as the drink is being returned to the table. This "taking a sip of a cocktail" hand motion may also be substituted by the facade of "taking a smoke from a cigarette." A chip, hidden in the hand used to grasp a cigarette from an ashtray, is inconspicuously added to the cheater's betting pile as the cigarette is being returned to the ashtray. The cheating gambler is a particular problem, because while their cheating techniques follow certain patterns, each has his or her own variations, and it is basically necessary to obtain clear evidence of cheating before the cheater can be arrested or barred from casino premises.

DISCUSSION OF THE PRIOR ART

Of the three potential problem areas discussed in the previous section, only the second and third problem areas have been competently addressed within the prior art. The dealer who cheats without the aid of another human being by secretly diverting casino chips into his or her personal possession has been addressed mostly by using encoded chips and accompanying sensors. Sensors can be placed in the personnel areas which are continually scanning the employees as they pass to and from the personnel areas and the casino floor. These types of sensor systems are also effective to prevent patrons from carrying chips outside the casino perimeter. The third problem area, which deals with players and dealers acting in concert to cheat the casino, has been addressed by creating decks of cards that allow the dealer to ascertain whether or not his/her hand comprises a blackjack or "21", but at the same time preventing the dealer from ascertaining the value of the face down card. The following patents are representative of some of the detection schemes previously suggested as used for surveillance of gambling operations:

U.S. Pat. No. 4,755,941 to L. Bacchi.

U.S. Pat. No. 5,283,422 to L. Storch and E. van Haagen.

U.S. Pat. No. 5,299,803 to J. E. Halaby.

U.S. Pat. No. 5,362,053 to A. Miller.

U.S. Pat. No. 5,406,264 to C. Plonsky and T. Riley.

U.S. Pat. No. 5,518,249 to R. Sines and S. Forte.

The full discussion of each referenced patent is detailed in co-pending application 08/763,767, now U.S. Pat. No. 5,831,527, such discussions being incorporated herein by reference. The prior art has largely directed its attention to the use of state of the art surveillance systems or "eye-in-the-sky" systems, plus the use of roving human observers, plus the monitoring of the movement of casino chips on the gaming table. The prior art largely fails to address the most serious problem facing every casino, namely the gambler who illegally influences his or her betted chips, whether it be a conventional wager or a non-conventional, so-called "bonus spot" wager, during the play of the game unbeknownst to the dealer or the roving security personnel. A common cheating scenario, in the game of blackjack for example, is the player who increases or decreases his or her wager once the dealer's hand is made public. Of course, this is accomplished as subtly as possible, and it is usually performed by a player sitting at the totally opposite side of the table from where the dealer's immediate concentration lies.

Traditionally, because of cost considerations, casinos only really direct their security efforts to a particular gaming table, or to a particular person, if and when they begin to suspect questionable activity occurring at such particular table. It is not until such suspicion arises, however, that the security issue becomes a matter of heightened concern. As a practical matter, it is nearly impossible to watch every single player at every single table, during every single moment of time. Video surveillance can only go so far, and the human element is always present in evaluating the actions of persons at the gaming tables and thus the effectiveness of this type of optical security system. For the most part, the dark globes that blanket the ceilings of most casinos serve as reasonable deterrent to cheating by the general public, since the players never really know who is watching or from where. Therefore, the casino as a practical cost related matter must depend to a large extent upon the basic honesty of most players, using the security systems available basically to keep the relatively honest gamblers honest from day to day in order to avoid the embarrassment of being caught cheating, while occasionally also catching regular cheaters and barring them from further access to the gaming tables or premises.

The cautious, previously deterred player, however, who one day attempts to cheat and gets away with it, and upon the realization that it is possible to repeat his or her cheating, may well convert from an honest player into one who actively flaunts the inadequacies of the available security system. Casinos are not allowed in many jurisdictions to take immediate action against a known cheater, unless the cheater's actions are recorded three different times, or at least more than once, so that a record can be created to add weight to the casino's reason for acting. Casinos usually either give the cheater a warning, confiscate his or her chips, or banish him or her from the casino altogether.

Regardless of what occurs, a tagged or identified cheater can usually walk next door to a neighboring casino and begin his or her cheating routine or scheme all over again. And if there is no other casino nearby, this cheater can go to another venue or jurisdiction, which provides legalized gambling. The expansion of the casino gaming industry progressively increases the number of gaming tables, thereby increasing the opportunities for cheating and incidentally the number of potential cheaters.

There exists a need, therefore, to provide a system or apparatus for detecting cheating in casino games by the detection of unauthorized movement over or in the vicinity of a casino game table.

OBJECTS OF THE INVENTION

It is an object of the present invention, therefore, to provide a device which can be incorporated into a casino gaming table to make the dealer, and/or any casino security official, aware of any player, at any time, who cheats by manipulating his or her chips during the play of any game.

It is still a further object of the present invention to provide a device which can be used with any existing, conventional gaming table, and does not require the manufacture of an unconventional gaming table top.

It is still a further object of the present invention to provide a device which cannot be visually detected by any person standing adjacent to the gaming table which has the device of the present invention within.

It is still a further object of the present invention to provide a device which will operate with conventional playing cards and conventional gaming chips, and does not require the use of specialized cards or chips.

It is still a further object of the present invention to provide a device which is resistant to the environmental hazards of casinos, and which will not be affected by any potential liquid refreshment spill hazards or the like which may potentially occur at the surface of a gaming table.

It is still a further object of the present invention to provide a device which can sense when a player's major body part, such as a hand, moves into or about a particular area on the gaming table, such as where the betted chips lie, and upon such occurrence, alerts an appropriate individual or system.

It is still a further object of the present invention to provide a device which, upon sensing a particular player's body part in or about a particular area on the gaming table, will send a signal to an appropriate individual or system alerting such individual or system to such player's movement.

It is still a further object of the present invention to provide a device which will alert an appropriate individual or system when a player cheats beginning with each individual occurrence, and does not necessarily first become activated upon the second or third occurrence of cheating by such player.

It is still a further object of the present invention to provide a device which can sense whether or not a dealer is following the standard dealing procedure, which instructs proper hand movement on or over the gaming table, proper hand placement during the dealer/player interaction, and proper hand movement when the dealer finishes the round of play.

It is still a further object of the present invention to provide a security device that is, or may be made, virtually undetectable by either the dealer or the player, or both, either by its physical presence or its operation.

Additional objects and advantages of the present invention will become evident from a careful review of the following explanation and description in combination with the appended drawings.

BRIEF DESCRIPTION OF THE INVENTION

The device of the present invention incorporates a system of sensors strategically positioned about a casino gaming table, although preferably placed under the surface of a gaming table, which monitor the movement about certain predetermined areas on the table, whether such movement may be initiated by a player or a dealer. The sensors of the system do not follow the movements of dealers or players, but merely monitor certain areas of the table and are triggered, or activated, or change state, if such sensors detect movement, or the presence of an object, in those specific areas. Therefore, the sensors are generally passive in nature, and require some kind of movement or change in position to become active.

In their simplest application, the sensors indicate when either a player or a dealer places his or her hand in an area of the table where it should not be placed during a specific time. Using roulette as an example, the sensor would indicate if a player moves a bet from one area of the board to another without the dealer noticing, and before the dealer begins to pay out. Using blackjack as an example, the sensor would indicate if a player places his or her hand in a position from which chips can be added or subtracted from his or her initial bet after the dealer exposes his or her face-up card. For tables that contain so-called "bonus spots," or a location accommodating a one-time wager based on a single outcome having greater odds, the sensor would indicate if a player participates in the bonus spot wager and/or adds or subtracts from such bonus spot after the dealer initiates the round of play. Of course, all of these situations are supposed to occur when the dealer "isn't looking," or is otherwise occupied. Usually, this occurs when the dealer is interacting with players at the opposite side of the table from where the cheating player is situated. The sensors may also indicate not when cheating may be occurring, but when certain playing procedures are initiated in order to begin or terminate certain surveillance procedures.

The sensors are generally located in three different areas of the gaming table, defined by the dealer's area, the player's area, and the gaming area. The dealer's area is located closest to the dealer, the player's area is located closest to the players, and the gaming area is usually where each player places his or her chips during the betting phase of the game. For example, in blackjack the gaming area would be defined by little, usually slightly hollow circles on the gaming table where each player stacks his or her chips during the initial ante, and any subsequent betting phase, including, if applicable, a "bonus spot" wager location, while in roulette the gaming area would be defined by the grid of numbers which indicate each player's chips and their respective wagers.

A control system of the invention, depending on the particular casino game, regulates when certain sensors are active, and when certain sensors are inactive, or should be de-activated. Normally, dealer interaction with each player at a table will help configure the control system. Using roulette as an example, sensors would line the roulette betting grid containing all of the player's bets, and would activate upon the spinning of the roulette wheel or the realization of the winning number. The sensors would remain active until the dealer has finished with all the bets, and then the sensors would deactivate in time to allow all of the players to gather their winnings. If a sneaky player decides to attempt to change the position of a chip on the betting grid in that split second between when the ball drops and when dealer scans the betting grid to acknowledge the winning number, interposition of the player's hand will activate the sensor and notify the proper person or system. In the case of roulette, the sensors could activate when the dealer declares the end of the betting and deactivate when the dealer begins to assess the betting grid to evaluate the winning positions.

The sensors used are preferably capacitative sensors, which have proved simple, economical, sturdy and difficult to change or miscalibrate by the normal mishaps in a casino environment.

It will be recognized that it is possible for the sensors to notify either a person or a system. The sensors can be linked directly to an individual, or to a notification system which can target and/or track the sensor activity present in the casino. A possible notification system can be audible, visible, electrical, computer-oriented or the like.

For the purposes of the following discussion, the games of black jack, roulette and mini-baccarat will be used to illustrate the details of such a device. The games of blackjack, roulette and mini-baccarat are merely three of many table-based casino games which can incorporate this device. Other possible games include pai gow poker, acey-deucy, Red Dog and the like. The present inventors do not mean to limit the device of the invention to any one particular game, since its implementation can benefit almost any table-based casino game involving cards or casino chips in addition to those detailed below.

BRIEF DESCRIPTION OF THE DRAWINGS

FIG. 1 is a diagrammatic plan view of an imaginary generalized upper surface of a casino game table for purposes of illustrating the playing of a casino game.

FIG. 3 is a diagrammatic view of a force field of a sensor upon a casino table for the detection of movement on such table.

FIG. 4 is a diagrammatic view of a conical force field of a sensor upon a casino table where the sensor is directly underneath the location to be monitored.

FIG. 4A is a diagrammatic view of a cylindrical force field of a sensor upon a casino table where the sensor is directly above the location to be monitored.

FIG. 5 is a diagrammatic plan view of an imaginary generalized upper surface of a casino game table for purposes of illustrating the device and the system of the invention while playing a roulette type casino game.

FIG. 5A is a diagrammatic plan view of an imaginary generalized upper surface of a roulette wheel for purposes of illustrating the device and the system of the invention while playing a roulette type casino game.

FIG. 6 is a diagrammatic plan view of an imaginary generalized upper surface of a casino game table for purposes of illustrating the device and the system of the invention while playing a baccarat type casino game.

DESCRIPTION OF THE PREFERRED EMBODIMENTS

Figure 2:
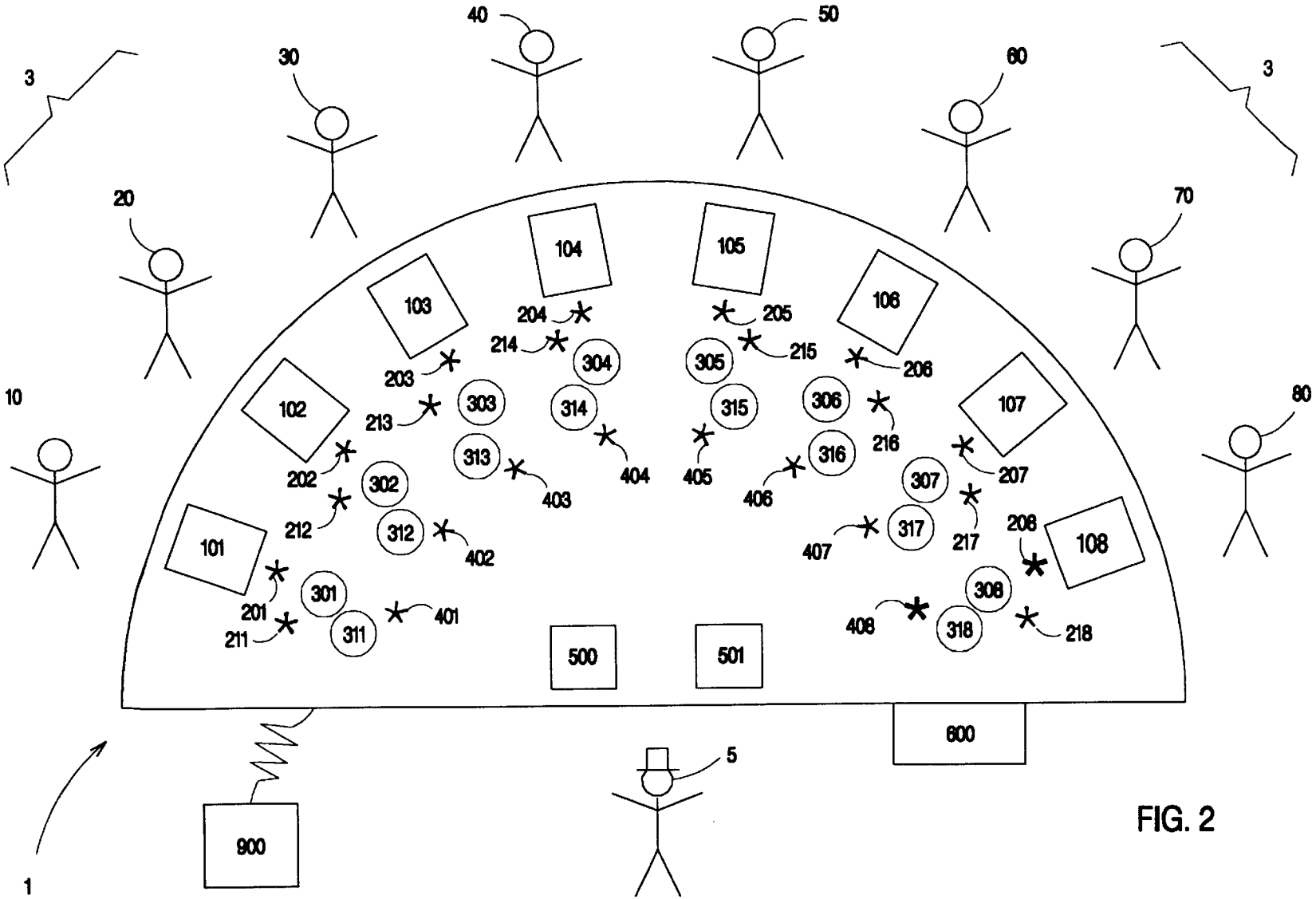
FIG. 2 is a diagrammatic plan view of an imaginary generalized upper surface of a casino game table for purposes of illustrating the device and the system of the invention while playing a blackjack type casino game.

The present inventors, after a thorough study of the difficulties encountered with cheating generally in games played on gaming tables in casinos, have developed a system for detecting the interposition of portions of the body of players's and dealers's over portions of gaming tables where movements pursuant to cheating usually take place or where movement is made during normal play in order to control the system. The preferred detectors are capacitive type detectors which are fairly cheap, sturdy, difficult to damage or miscalibrate and effective without modification of the chips or the like. Any movement that disturbs the magnetic field produced by the sensor will be detected and may be used to trigger the sensor's recognition system. Consequently, the system will trigger whether movement is made over predetermined portions of a gaming table by the human hand, a casino chip, a dealer's card, or the like as long as the field is broken by some object. Other types of detectors such as inductive sensors, ultrasonic detectors, pyroelectric sensors, and the like could also be used. As indicated, capacitive sensors are preferred. The system has basically three parts, namely:

(a) an initiation and deactivation portion or system that automatically activates the system preferably without the explicit knowledge of the players or the dealers, usually by the interposition of the dealer's hand over a specific portion of the gaming table as part of the game or preliminaries to the game or ending of the game, (b) a portion or system for detection of unauthorized movement over the gaming table in areas where players will usually attempt to move something on the gaming table, such as casino chips or cards on the table, during actual play (this system may include a discrimination routine to determine a certain pattern of activity usually involved in cheating), and (c) a portion or system for alerting security personnel of the unauthorized activity.

The initiation and deactivation system may be broken up into two separate subsystems for initial activation of the system and for deactivation of the system after play so that harmless activities such as clearing chips or cards from the table will not trigger an alarm.

FIG. 1, which shows a diagrammatic plan view of a hypothetical generalized casino table for the playing of a casino game, lays the foundation through which more specific casino games will be explored in more detail. In general, there is provided a casino gaming table 1 which is supervised or operated by a representative 5 of the casino, who is usually designated as the "dealer," if the game is based on cards. However, the casino representative 5 may not actually be a "dealer" in the sense of dealing or giving out cards, since he or she could also be the person who spins the roulette wheel, or the person who spins the money wheel, or the "pit boss" or the two "side people" in a craps game. On the other side of the gaming table 1 are located the players 3, here specifically referred to as 10, 20, 30, 40, 50, 60, 70 and 80. Eight players are depicted for purposes of illustration herein, although some casino gaming tables conventionally have seating for five, six or seven players, usually depending on the stakes and nature or type of game. The casino representative 5 is usually located on one side of the table 1, and is situated directly opposite the players 3. The table is comprised of three general regions, namely the player's area 110, the betting area 100, and the casino representative's area 90, in accordance with the description previously provided. The player's area 110 usually is provided with the player's own betting chips, which are not the same chips used to represent the player's wagers during the game. The players's chips that represent wagers are usually placed in some particular location in the betting area 100, such as, for example, a wagering "circle" onto which chips are placed or stacked for normal betting, or a select "bonus spot" onto which an initial wager is placed pending a unique, predetermined game outcome. The boundary 97 between the player's area 110 and the betting area 100 is the focus of much of the sensor activity of the present invention, since any activity of the player that crosses this boundary 97 during the play of the game, in order to surreptitiously or illegally influence his or her standing wager, is that which the device of the present invention is designed to detect. The boundary 95 between the betting area 100 and the casino representative's area 90 is usually not the main focus with respect to the individual players 3 since the players 3 do not usually extend their reach past the betting area 100. The device of the present invention is particularly designed to monitor the boundary 97, therefore, in some manner, so as to place the casino on notice when any player crosses that boundary 97 with the intent or hope of surreptitiously or illegally manipulating his or her wager. In general, therefore, in accordance with the invention, motion detector apparatus will be provided to detect any activity taking place across the boundary 97 as between the player's area 110 upon which the players 3 may place their hands, lean with their elbows, rest their drinks or the like, and the betting area 100, in which gambling chips representing the wagers of the players and the like may be placed. In addition, the dealer's area 90 is usually provided with detectors to activate and deactivate the system at certain predetermined times depending upon what the dealer 5 does in running the game. The monitoring device 900 will provide for communication of the activity on the table 1 when any of the sensors are activated, and provides for communication of the activity on the table to security personnel or a central monitoring system such as a computer or the like. Only signals indicating unauthorized movement in the betting area are usually passed to the security personnel or central security system.

The monitoring system 900 is an integral element of the device of the present invention, and can assume a wide variety of embodiments. The present inventors envision at least three different monitoring variations, depending on the number of tables monitored and the type of technology implemented. For purposes of illustration, assume that there are five tables being monitored at a given time in a given location of the casino. Three different monitoring variations could then be as follows:

(1) An externally visual system which identifies the table number and the player at such table, either in the form of lights or LED signals, that are either visible from the casino floor or from a hidden place. If in the form of lights, one row of five lights may represent the five tables directly above a second row of eight lights representing the eight players at each table. Assuming that in the first row of lights on the visual monitoring device, the third light is lit, while the second light is illuminated in the second row of lights, monitoring personnel will be advised that the second player at the third table has tripped a sensor. Such personnel will then either reset the table or direct their attention accordingly. A LED based system may utilize two numbers, one number representing the table while the other number represents the player, using a similar overall code to that used by the light-based monitoring system. Any other convenient alerting or coding arrangement may be used.

(2) A second possible arrangement might be an audible system, where the monitoring system alerts roving security personnel as to the table and player, such sensor signal being converted directly into an alert response signal received by portable radio or wireless communication apparatus carried by security personnel. Another possible audible variation might utilize a similar code system as used with the lights, where the table representation might, for example, take the form of long audible tones, and the player representation might take the form of short audible beeps. Therefore, if the second player at the third table has tripped his or her sensor, then someone may hear "booop booop booop bip bip" and be alerted to that particular location.

(3) A third possible arrangement involves the use of a central monitoring station, probably computer equipped, which can detect the activity of every table being monitored at once, and respond accordingly, either with signals or through appropriate action. For example, if sensors at one table are tripped three times in one minute, the monitoring station may then direct the camera's eye to that table. If such table keeps having problems, then the monitoring station may boost the security at the table by alerting one or more of the roving security personnel. In other words, the monitoring system may not alert actual human personnel immediately, and may wait until an increased predetermined minimum amount of unauthorized activity is detected.

The monitoring system 900 is not restricted in scope by the detection arrangement or system of the present invention, since the system of the present invention is concerned with detecting movement on or about a casino gaming table and emitting a signal to that effect. How each casino utilizes this signal will determine the scope and effect of the monitoring system 900 The present inventors envision a preferred embodiment for the monitoring system to incorporate a central computer system which records, digests, and disseminates information in accordance with the signal it receives from the casino gaming tables. The monitoring system 900 is represented in an identical manner for each game detection system disclosed in this application. The monitoring system 900 is not meant to be restricted to what has been described, but is meant to accommodate the specifications of both the number of tables, each casino's technical capabilities, and how each casino wishes to utilize the information that is monitored and detected.

FIG. 2 is a diagrammatic plan view of a blackjack game table and shows an implementation of the device of the present invention in the game of blackjack. The semi-circular table 1 has a casino representative 5 here the dealer, facing eight players positioned around an arcuate portion of the table designated 10, 20, 30, 40, 50, 60, 70 and 80, with the first player 10 located to the dealer's immediate left at the corner of the table, while the last player 80, or eighth player, is located directly opposite the first player 10 at the opposite corner of the table. While conventional seating for a blackjack table is seven players, the present inventors are illustrating the operation of the device of the present invention with eight players to demonstrate its versatility. It will be recognized that the number of players around a gaming table in connection with which the device of the present invention is implemented is limited only by the size of the physical table and not necessarily by the capacity of the dealer's attention. The device of the present invention will actually work with as few as one player, or as many as "n" players, where "n" is some definitive number above which the system is not designed to handle. It is customary for the dealer 5 to approach or address the players 3 in a clockwise fashion around the table, hence the dealer 5 starts with player 10 and finishes with player 80. The device or system of the present invention will operate regardless of the number of players sitting at the table; however, for purposes of illustration, it will be assumed that such table 1 contains eight players who are actively participating at all times.

Since table 1 depicts a conventional blackjack table, each player has a designated area for their cards, and each player has a designated area for their wagers. The card locations are designated in FIG. 2 as 101, 102, 103, 104, 105, 106, 107 and 108 (defined collectively as "1O*x*", for each of the eight players), while the wager locations are similarly designated 301, 302, 303, 304, 305, 306, 307 and 308 (defined collectively as "30*x*"). The wager locations are usually comprised of hollow circles in the table surfaces, since hollow circles form the most appropriate boundaries for circular casino chips, although the shape of the wager location has no effect on the operation of the device of the present invention. The wager location could also comprise non-conventional areas, such as so-called "bonus spots," whereby a single wager is made prior to the beginning of play that enables a player to be eligible for a "bonus" amount should a certain predetermined hand be dealt or a certain outcome realized either at the same table or a different location in the casino. The dealer's card locations are defined by the dealer's first card location 500, which can either represent the face-up or face-down card, and the dealer's second card location 501, which can also represent either the face-up or face-down card. The first card dealt by the dealer to himself or herself is usually the face-up card, and the second card dealt by the dealer to himself or herself is usually the face-down card.

FIG. 2 also depicts two other locations correlated with each player, for operation of the device of the present invention, and an additional location of interest for the dealer. The locations designated 201, 202, 203, 204, 205, 206, 207 and 208 (defined collectively as "20*x*") indicate the normal locations of player sensors which are strategically located between the card locations 10*x* and the wager locations 30*x*. In addition, the locations designated 401, 402, 403, 404, 405, 406, 407 and 408 (defined collectively as "40*x*") indicate the normal locations of dealer hand sensors which are strategically located between the dealer 5 and the wager locations 30*x*. Both sets of sensors, which form an integral part of the device of the invention, are physically located out of sight of both the players 3 and the dealer 5 or any other observers. The most preferable location would be underneath the surface of a conventional casino table, although the sensors could also operate from above the table, where its focus would be in the identical locations as designated 20*x* and 40*x*. A sensor location of particular importance to the dealer is designated 600 representing the dealer discharge location. Sensor 600 is triggered when the dealer clears the table of all of the played cards and ends the round of play and thereby deactivates the table.

The sensors indicate movement about the regional area of their location dependent upon their sensitivity. The location of the player sensors 20*x* are strategically arranged about the wager locations 30*x*, because a player must bring his or her hands into or invade the wager locations in order to manipulate his or her conventional wager, or "bonus spot" wager (locations 311, 312, 313, 314, 315, 316, 317 and 318 or "31*x*" collectively) or the like as the case may be. In other words, if a player wishes to increase or decrease his or her wager in the hopes of not alerting the dealer, such player must enter the area defined by the wager locations 30*x* with a part of his or her body in order to accomplish this. If the sensors 20*x* are activated at such time, such movement will be detected and brought to the attention of anyone monitoring the system 900.

Figure 2A:
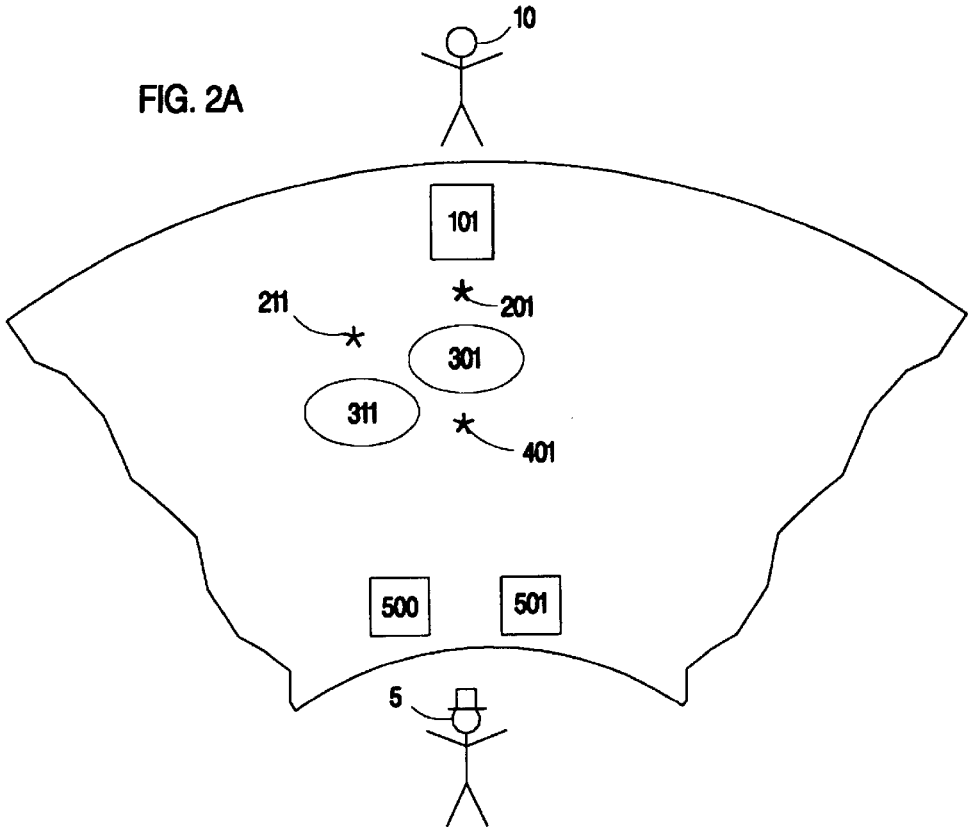
FIG. 2A is a diagrammatic plan view of a section of a blackjack game table showing a sensor arrangement between the dealer and a single player.

FIG. 2A illustrates a sectional view of the sensor arrangements between a single player, here designated 10 and the dealer 5. A typical operational mode of the system, which will be more fully described later, occurs when the dealer 5 has completed dealing the initial cards to every player at the table, and then reveals his or her first card to be placed in location 500. The act of placing a card on the face-up location 500 ending the official deal is detected by the sensor at that location and activates all of the player sensors 20*x*. At such time, the player's initial wager positioned in location 301 becomes guarded, and any additional wager positioned on another location such as a "bonus spot," shown in FIG. 2A as location 311, would also become monitored. If a player wishes to illegally increase or decrease his or her wager after seeing the dealer's face-up card, he or she would have to physically invade the wager location area, and as a consequence, trip the sensor which protects such area, and would thereby send a signal to the appropriate person or system. Such sensor would protect all of the wagering locations if more than one were present, such as with a bonus spot, or a separate sensor 211 (shown in FIG. 2 as sensors 211, 212, 213, 214, 215, 216, 217 and 218 or "21*x*" collectively) could be positioned adjacent such location 311, which could act separately or in concert with player sensor 201. For example, sensor 211 could be employed to both track the initial wager placed at the location 311, and also protect such location after the round of play has begun.

It might be important for a casino to separately manage or monitor a separate bonus spot-type location such as is designated 311 in FIG. 2A, because such spot usually involves heightened payoffs. Generally, a "bonus spot" wager is usually placed prior to the beginning of the normal round of play and is only paid out if a certain, predetermined outcome is realized. Consequently, a bonus spot wager is usually made at the very beginning, and generally remains or should remain undisturbed until the round of play has ended. However, whenever a bonus wager is made or placed under local rules, the bonus spot should then remain undisturbed until the end of play or other set time. A sensor 211 used as a tracking mechanism might, for example, detect the contribution of a wager to such location 311 prior to the beginning of play, and the triggering of such sensor 211 could then send a signal to a dealer location (not shown) that assists the dealer in tracking players that participate in the bonus spot round. For example, a series of lights (not shown), each representing a particular player at the table, may initially be dark, but as each player triggers the sensor and contributes a bonus spot wager, such player's respective light would be lit, and would stay lit until the end of the round. This could also occur manually by the dealer's touch of a button or the flick of a switch as each contribution is made. After the players contribute their bonus spot wagers, and the round of the play begins, the system of the present invention would "lock" such bets into the system, thereby preventing someone from contributing a wager after beginning the round of play. Again, such "locking" could occur manually with the push of a button or sensorially with the dealer's wave of a hand. In other words, as the dealer waves his or her hand over a particular sensor and in front of the betting players signaling and possibly stating "no more bets," for example, all of the bonus spots that have chips or wagers thereon would be locked in while the remaining bonus areas would be disabled from taking any bets without signalling. Similarly, the sensor 211 could also be used simultaneously to monitor the location 311 during the round of play, similar to the way sensor 201 monitors location 301. For example, if the bonus spot wager "hits," or pays off, sensor 211 would prevent players from illegally introducing or amplifying a wager onto the bonus spot location 311 after the round of play has begun. Or, such implementation of the system could be accomplished manually as the case may be with the push of a button or the like.

Figure 2B:
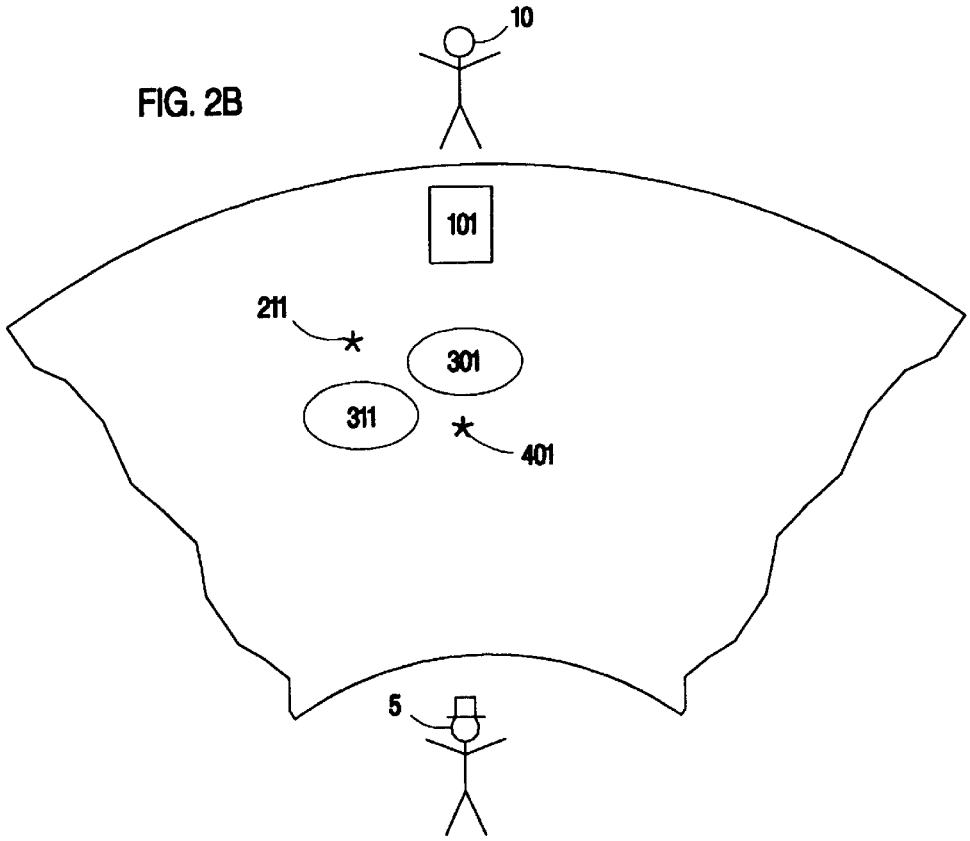
FIG. 2B is a diagrammatic plan view of a section of a poker game table showing a sensor arrangement between the dealer and a single player.

The usage of "bonus spots" and the like are conventionally implemented in casino games such as poker, where the bonus spot payout would be realized by the highest possible hand, i.e. a royal flush for example. There may be certain situations, for example, where only a bonus spot on a casino gaming table might be monitored, as shown in FIG. 2B, in which case a sensor 211 would be affiliated with just the bonus spot 311 and the conventional wagering location 301 would remain unmonitored. Of course, if the casino wished an arrangement such as shown in FIG. 2A where sensors 201 and 211 monitor locations 301 and 311, but at times only wanted one set of sensors to be operational, such as, for example, if the casino only wanted to monitor the bonus spots, the casino could implement a control system activated either manually or automatically (sensorially) that disables one set of location sensors while keeping the other location sensors activated. Therefore, the casino could equip a table for monitoring a conventional wagering location, 301 for example, and/or a bonus spot location, 311 for example, and, dependent on the particular monitoring arrangement, have only one or both sets of sensors active for a particular game or table. The position of the wagering location and bonus spot location shown in FIGS. 2 through 2B are representative samples of conventional positions on a gaming table. Other positions may be realized depending on the needs of the casino and the particular game being played.

Returning now to the play of the game, if no player activates their respective sensor or sensors, i.e. if no player decides to cheat or otherwise activates the sensors, then the dealer starts to progress around the table to elicit each player's betting response. The conventional act of the dealer placing his or her hand on the table and pointing to a player triggers the dealer's hand sensor, here shown as 401, and this deactivates the sensor of the player who is being acknowledged by the dealer, while the remaining players's sensors remain activated. The triggering of the dealer's hand sensor in front of that respective player indicates that the dealer is focused on that particular player, and therefore there is no need for that player's sensor to remain activated, since the dealer will take note of an illegal activity of the player, who is unlikely to take an illicit action in any event. Deactivating that particular player's sensor also allows that player to legally increase his or her wager in relation to any additional cards requested by the player, such as with a "double-down" or a "split" bet, where both bets require the player to increase his or her wager in order to receive an additional card. The remaining players's sensors remain activated because there is an added incentive to cheat while the dealer is being distracted with another player at the opposite end or any other part of the table. When the dealer finishes with that particular player, he or she points at the next player and by placing his or her hand within the range of the next dealer hand sensor, which reacts by sending a signal to the system deactivating the next player's sensor and reactivating the previous player's sensor. As the dealer progresses around the table, the act of the dealer pointing to each player and eliciting a response from each player deactivates such player's sensor and concurrently activates or keeps activated all the other players's sensors. While the bonus spot location 311 and respective sensor 211 are shown in FIG. 2A adjacent the conventional wagering location 301 and respective sensor 201, such location 311 and respective sensor 211 could be located elsewhere, and if such location 311 were sufficiently near to the conventional wagering location 301, it might be possible to cover both locations 301 and 311 with the original sensor 201, for example. It is understood that such additional "bonus spot" location 311 does not necessarily have to represent a wager entitled "bonus spot," but could also apply to any non-conventional wager that is placed at the beginning of play, or separate from, or even at the same time as the normal round of play. It is also understood from the aforementioned description that the additional wagering location, or locations as the case may be, may be positioned along each player location (reference FIG. 2) and form part of an entire gaming table.

FIG. 3 illustrates a typical sensor range if the actual sensor were located underneath the surface of a table 1. If the middle of the sensor was designated 20*x* as shown in FIG. 3, where the designation 20*x* represents, as defined above, the respective sensor more fully defined as sensors 201, 202, 203, 204, 205, 206, 207 and 208, then the sensitivity and reach of the sensor could be defined by a semi-circular, spherical region, which would extend a radial distance 93 along the table 1, and similarly a radial distance 96 above the table 1. The sensitivity of each sensor is directly related to the radial spherical region which defines the sensor's reach.

Figure 3A:
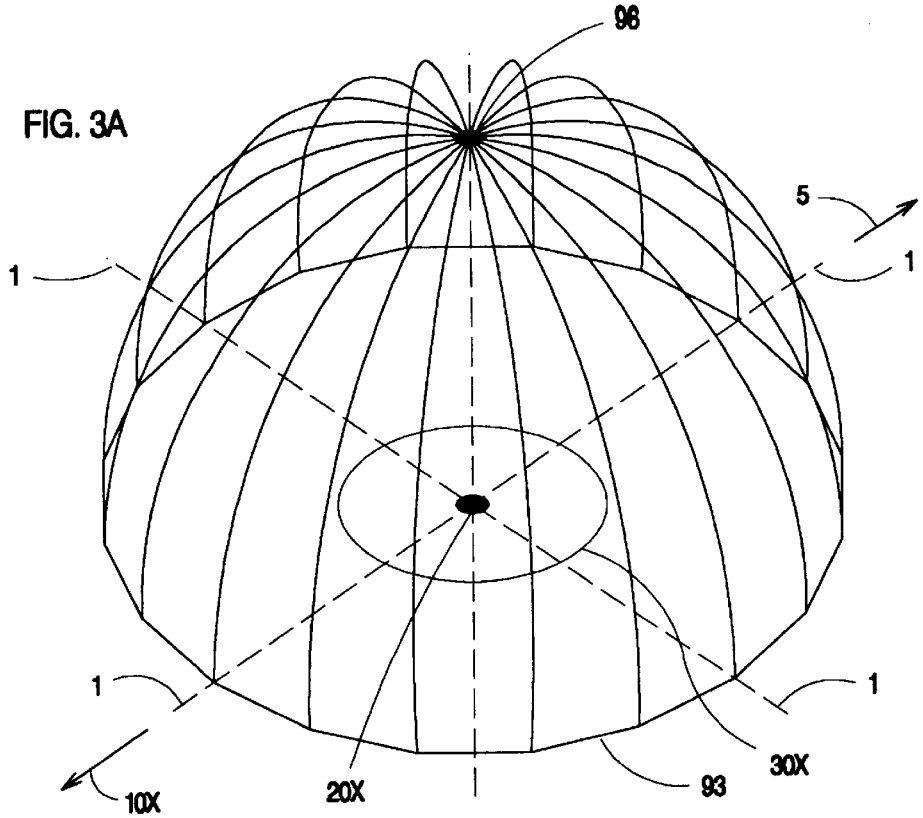
FIG. 3A is a diagrammatic view of a force field of a sensor upon a casino table where the sensor is directly underneath the location to be monitored.

FIG. 3A illustrates the sensor's range in relation to a wager location 30*x*, a player card location 10*x* and in further relation to the dealer 5. It should be apparent that when the sensor 20*x* is located concentrically beneath the wager location 30*x*, the sensitivity will be felt around the entire wager location 30*x*. This means that the effectiveness of the sensor 20*x* will extend to areas where the players are not likely to reach, i.e. the part of the sensor region closest to the dealer. A player must also come very close to the wager location and sensitivity boundary in order to trigger the sensor.

Figure 3B:
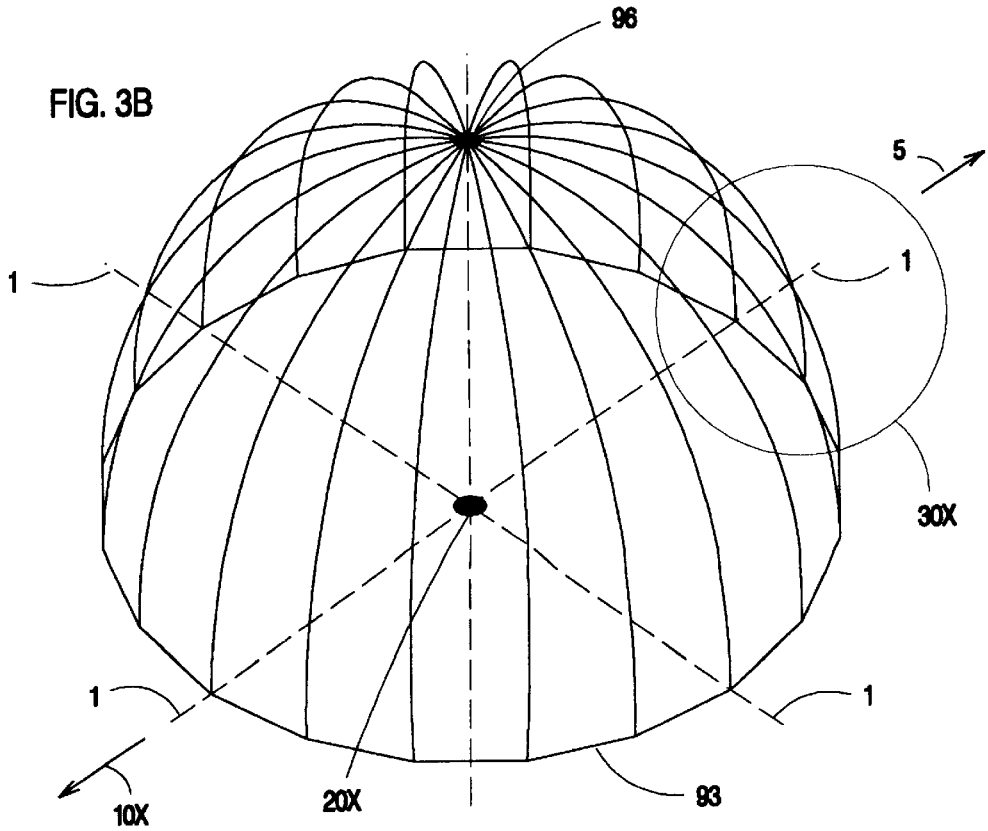
FIG. 3B is a diagrammatic view of a force field of a sensor upon a casino table where the sensor is directly before the location to be monitored.

FIG. 3B illustrates a preferred player sensor location 20*x* which would be, from the player's perspective, between the player's card location 10*x* and the player's wager location 30*x*. With the player's sensor location 20*x* directly before the player's wager location 30*x*, a player would trigger the sensor upon merely approaching the wager location 30*x*, which would occur at a much earlier time than as depicted in FIG. 3A, where the player must almost be on top of the wager location 30*x* in order to trigger the sensor.

FIG. 4 illustrates a cone shaped field 98, as opposed to the spherical fields of FIGS. 3, 3A, and 3B. The field shape is determined by the type of sensor, and the intensity and dimensions of the field are also determined by the type of sensor and the amount of power supplied to the sensor. It is recognized that a variety of sensors may operate effectively, each possibly having a unique sensor field. It will also be recognized that while conventional discrete, well defined fields are shown in the figures in accordance with convention and convenience, that the fields will actually be weaker with increasing distance from the detector and the detection of various movements or intrusions will vary across the field. It is preferable, however, in most cases to have detectors with as well defined detection or activation fields as possible to avoid interference between adjacent detectors. The fields shown in the figures may be considered, therefore, the effective or practically usable detection fields as contrasted to maximum detection fields.

The player sensors could, therefore, project or provide not only subsurface emanating fields, but also fields which emanate from other parts of the casino. For example, the player locations could also be monitored from above the table (FIG. 4A) via a reflective-type or infra-red arrangement from the ceiling, which establishes a cylindrical perimeter field 99 between the table and the sensor. Any break in the sensor field would then trigger the sensor. The dealer sensors, and especially the dealer card sensors, should remain subsurface since the dealer is constantly passing directly over his or her sensors to interact with the players. The intensity of the dealer's sensors can vary so the effective field only extends one inch (or even one card width) above the surface of the table, and this is helpful since the dealer card sensors would otherwise be triggered every time the dealer passes over his or her cards on his or her way to addressing each player.

It will also be understood that the sensor fields demonstrated in FIGS. 3 through 4A would also apply if the gaming table were equipped with "bonus spot" locations designated 31*x* (or more specifically, as shown partially in FIG. 2A as 311, 312, 313, 314, 315, 316, 317 and 318) and with such respective sensors 21*x* (or more specifically, as shown partially in FIG. 2A, 211, 212, 213, 214, 215, 216, 217 and 218)

Previously filed copending application 08/763,767, now U.S. Pat. No. 5,831,527, contains Tables 1 through 10, illustrating some of the control relationships between the dealer's action and the player's sensors. Such tables are incorporated herein by reference, and the control relationships will only here be briefly described. At the beginning of a card-based game and prior to the initial deal, all of the players's sensors 20*x* are deactivated. If the casino is tracking a "bonus spot" wager, then sensors 21*x* may be activated by the dealer to monitor and record the players participating in such bonus spot wager. As described above, such sensors 21*x* may automatically track the initial participants, or the dealer may do so manually with a push button or the like. Prior to the initial deal, for example, the dealer may lock the bonus spot wagers into the system of the table using a sensor-triggered hand movement or a manual operation. When the dealer finishes dealing all the players's initial cards, and places, in a blackjack game for example, his face-up card on location and sensor 500, as shown in Table 2, the sensor at location 500 will be triggered and all of the players's sensors 20*x* and/or 21*x* will activate. All of the players's sensors activate upon the revelation of the dealer's face-up card in order to counter the increased incentive to cheat when the first comparison is made between the player's hand and the dealer's potential hand. The dealer then finishes distributing the final cards to each player and places his or her second card face down on sensor location 501.

As the dealer initiates the interaction with the players, usually by pointing at the first player to elicit a response of "hit", "stay", or another appropriate wagering action by the player, the dealer places his or her hand on or close to the respective dealer hand sensor, which triggers the appropriate player hand sensors in one of a number of ways. For example, one control system would deactivate the sensors of the player directly elicited by the dealer, with the other player sensors remaining activated, such being the most secure approach. Another approach would be to deactivate the sensors of the player being elicited along with the players on either side of such elicited player, since the dealer will presumably have an uninterrupted view of the player directly in front of him or her, including a peripheral view of the players directly adjacent such elicited player. Another approach would be to deactivate the sensors of the elicited player, along with the player directly following, or directly behind such elicited player. These different control theories are best suited for a sensor system which utilizes a separate sensor for each individual player. However, it should be realized that due to the spread of the detection area of the detectors, an operative system can be designed which uses fewer than one detector for each player, the one-to-one relationship being only preferable. For example, a control theory could comprise, for example, three distinct groupings of players, namely the first three players, the second three players, and the last two players, each grouping being activated and deactivated in turn, and this would occur when the dealer addresses any one of the players within the grouping.

After the dealer has finished addressing each player, he or she reveals his face-down card at location 501 and plays out his hand until he or she either "busts" or loses in a game of blackjack, or has to "stay" if the dealer's hand totals 17 or over. At this point in time, all of the sensors are activated. When the dealer's hand is determined, the dealer must either pay the winning players or collect from the losing players. The conventional way the dealer addresses each player during the payout and collection process is in reverse order to that of the normal betting and playing stage, i.e. starting with the last player at the table and ending with the first player elicited during the betting stage. As the dealer pays out or collects from each player, that player's sensor becomes deactivated, and remains deactivated until the game is reset. If, during the play, the control theory which governed the activation and deactivation of the sensors was limited to one player at a time, then the control theory for the sensors during the payout/collection would basically resume in reverse, but as the dealer addresses each player, the sensors of such player would remain deactivated, until the entire table is essentially deactivated pending the next round of play. During the payout/collection stage, therefore, the only player sensors which remain active are representative of the players which have yet to be addressed by the dealer, i.e. which have yet to receive their winnings or relinquish their losses.

After the dealer pays or collects, he or she will gather up all of the used cards, including the dealer's own cards, and place them in the discard rack. When the dealer places all of the discarded cards in the discard rack, the dealer will trigger, or cross over, the dealer discharge sensor at location 600. The activation of the dealer discharge sensor will deactivate and reset the entire table. Once the dealer discharge sensor 600 is activated or triggered, the player sensors will remain off, or nonactive, until a new hand is dealt and the dealer deals his or her first card and activates the sensor at location 500.

FIG. 5 illustrates an embodiment of the device of the present invention adapted to be used on a roulette gaming table. The present inventors have found that the sensor systems can effectively operate with almost any imaginable casino gaming table, with the possible exception of "craps" where it would most likely be unnecessary due to the nature of the game environment. A roulette table is, for the most part, identical in player layout to any other casino gaming table, where a number of players surround a table and wager in an area in front of them while maintaining their own chips by the edge of the table. With reference to the generalized gaming table shown in FIG. 1 and in coordination with and supplementing the earlier discussion of such figure, the roulette board of FIG. 5 can be considered the actual gaming area 100, with the outer boundary of the roulette board identical to the boundary 97 between the players and the gaming area shown and discussed in FIG. 1. The gaming area in roulette is not broken up into eight different player locations like it would be in blackjack, but consists of an entire area of the gaming table within which each player may interact.

Figure 5B:
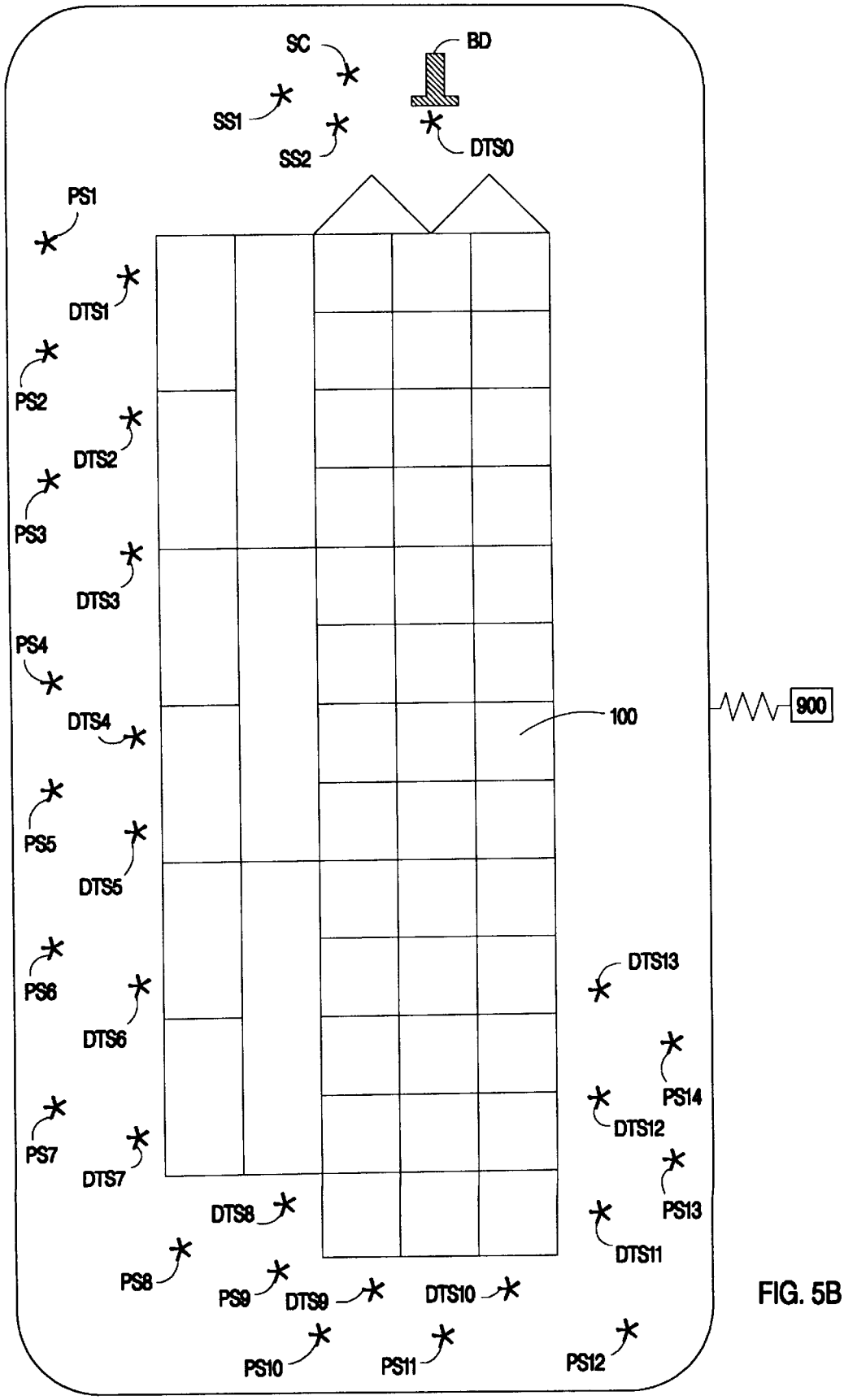
FIG. 5B is a plan view of an imaginary generalized upper surface of a roulette casino gaming table for purposes of illustrating an alternative embodiment of the device and the system of the invention.
Figure 5C:
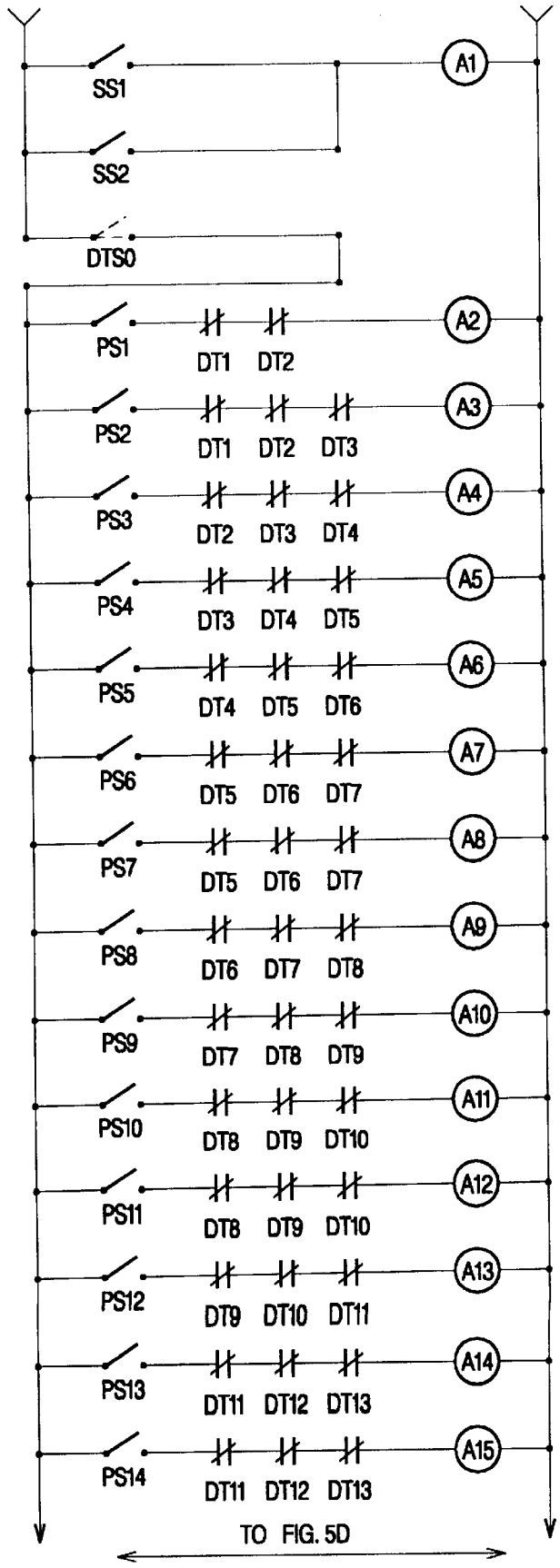
FIGS. 5C and 5D are circuit diagram-of the system of the invention as it is used with the roulette-type casino game of FIG. 5B.
Figure 5D:
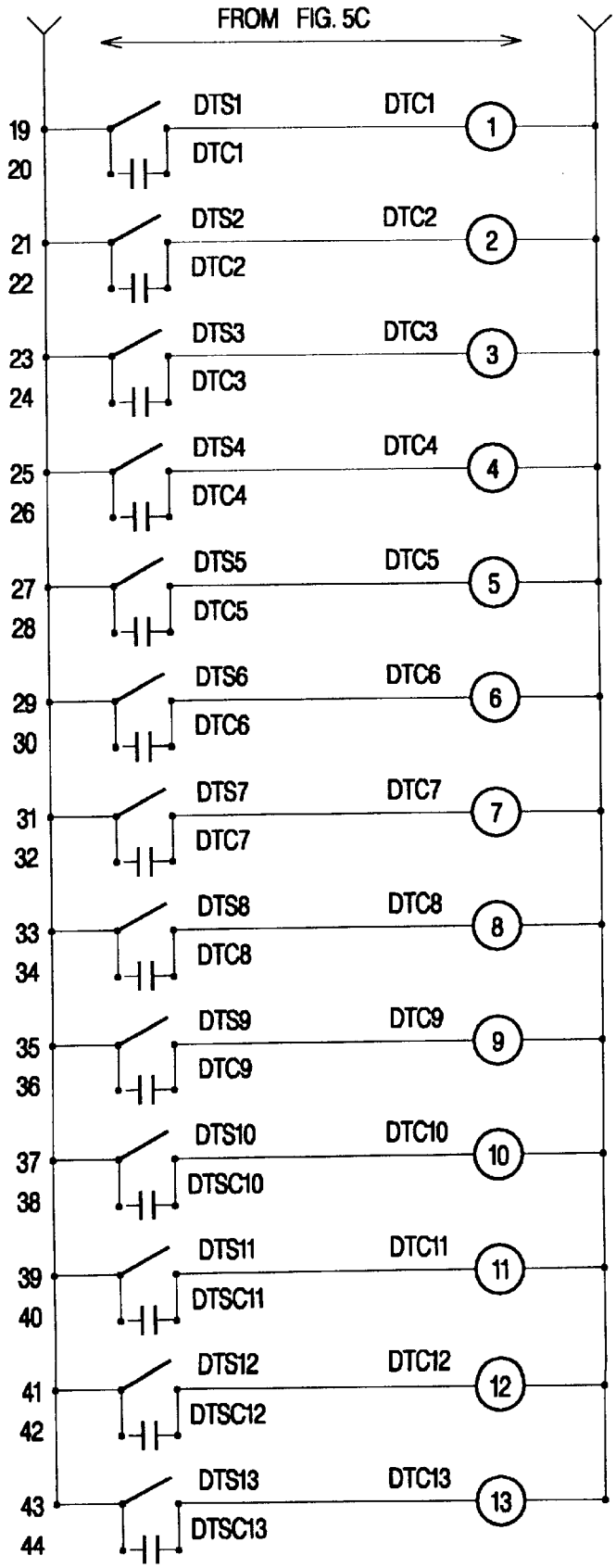

In FIG. 5, the player sensors 20*x* can assume a variety of different embodiments, depending on the type of security one wants to achieve. As with the game of blackjack, each player sensor location 20*x* can be directly in front of each player location 10*x*, which would achieve a secure area directly in front of each player (see also FIGS. 5B through 5D). However, since the game of roulette is structured differently, and since each player does not necessarily interact with the area of the table directly in front of him or her, a somewhat preferred arrangement would be to effectively "line" the outside boundary of the roulette gaming area 100 with multiple sensors or even a single strip sensor 299. A strip sensor 299 would effectively leave no area unsecured.

The game of roulette by its very nature requires the incorporation of a slightly different control theory, since the player/casino representative interaction is not as direct or one-to-one as with blackjack, however, the payout and collection interaction is one-to-one with almost every game. Roulette only really involves one move on the part of each player, the initial wager. Each player at the table places his or her particular colored chip(s) on a particular location(s) on the roulette board. Afterwards, the casino representative will start the roulette wheel spinning and project the ball around the outer perimeter of the roulette wheel in the opposite angular direction to that in which the wheel is currently spinning. Depending on the casino, all wagering will cease either once the ball is in motion, or alternatively several seconds before the ball lands in a numbered spot. The decision as to when the wagering will cease will govern the decision as to when to introduce the device of the present invention to the play sequence or activate the security monitoring mode of the invention.

When the wagering ceases, the sensors 20*x* or 299 should be activated. These sensors may be activated either manually by the dealer or automatically using a sensor-triggered event. FIG. 5A depicts a top view of a typical roulette wheel 700, which is comprised of the outer perimeter track 710 upon which the ball travels when initially spun about the wheel 700, a slide 720 upon which the ball travels when it starts to make its descent upon losing momentum from the track 710, and the slotted wheel 730 in which the ball will eventually come to rest on a particular colored number. The activation of the sensors 20*x* or 299 can be done externally by action of the dealer, or in the embodiment of FIGS. 5 through 5A, automatically through the coordinated action of the spinning wheel and the travelling ball. If the casino wanted to secure the table upon the initial launch of the ball, a sensor 715 would be placed on the outer perimeter track 710 which could, for example, be triggered after one revolution of the ball.

If the casino wanted to activate the table after the ball starts to make its descent, a sensor 725 could, for example, be placed on the slide 720 which would be triggered after at least one revolution on the slide. In order for sensor 725 to fail to operate effectively, the ball would have to vertically drop from the outer perimeter track 710 to the slotted wheel itself 730. This problem could be alleviated by lining the slide 720 with a series of sensors around an inner circumference which defines a perimeter section of the slide 720, or possibly by incorporating a singular ring-shaped sensor mechanism which would operate in the same fashion. Sensor 725 could be eliminated using the track sensor 715 in combination with a statistically determined control theory. A study could be made, for example, which could determine the average number of times a ball would revolve about the outer perimeter track 710 before leaving the track 710, and this could be done using sensor 715 in an iterative fashion. The sensor signals could be counted and averaged, and this average number of signals can be used to determine when the table should be activated. For example, assume that an average ball revolves ten (10) times around the track 710 before it starts to make its descent toward the wheel. After about the seventh or eighth revolution, i.e. after about the seventh or eighth sensor signal, the table sensors would activate. Of course, there would have to be some kind of coordination with the casino representative who is launching the ball and the time at which the table would be activated, for if not, then the table would activate while the customers continue to place their bets and before the dealer terminates the wagering.

Another possibility for the casino would be to activate the table when the ball hits, or is about to hit, the actual wheel 730, in which case a sensor 735 would be placed in such a desired location. Sensor 735 could be located directly beneath the wheel, or directly before the wheel, or even located physically within and under each number on the wheel. The preferred location of sensor 735 would be directly before the wheel, since the movement of the actual wheel, before the movement of the ball, would most likely prematurely trigger the sensor 735.

An alternative embodiment of the system of the invention used with a roulette table is shown in FIG. 5B, which is a diagrammatic plan view of a generalized upper surface of a roulette table, and FIGS. 5C and 5D, which are circuit diagrams illustrating the control theory of the system of the present invention as described in connection with FIG. 5B. FIG. 5B shows a roulette gaming board 100 having fourteen player sensor locations PS1 through PS14 (designated collectively as "PSx") and thirteen dealer trip sensor locations DTS1 through DTS13 (designated collectively as "DTSx"). Two security sensors SS1 and SS2 shown in FIG. 5B and illustrated on FIG. 5C, Line 1 and 2 are always on to protect the stacks of chips SC which are not currently in use or play. When either or both of the sensors SS1 and/or SS2 are energized or activated by a player or dealer infringing in that area of the table in an inappropriate time period, a signal A1 (see FIG. 5C, Line 1) will be generated. The type of signal and course of action to be taken will be a choice to be made by the casino management as mentioned and described previously herein with respect to system 900

A brass dolly BD, conventionally used in the game of roulette to indicate the winning number, is generally at rest at a sensor location DTSO shown near the security sensors SS1 and SS2 in FIG. 5B and in FIG. 5C, Line 3. When the dolly BD is on sensor DTSO, the player and dealer sensors PSx and DTSx are deactivated or not energized. As soon as the brass dolly BD is removed from the sensor DTSO, player security sensors PSx become energized. The dolly BD is usually removed from DTSO just prior to the revelation of the winning number, and upon such revelation, is placed on the winning number on the game board 100 in preparation for the payout and collection stage. Sensors PSx will now send a signal of the casino's choice to a location of casino's choice, and such sensors PSx will remain energized until dolly BD is returned by the dealer to its resting spot DTSO or by the dealer trip sensor's DTS1 through DTS13 during the dealer payout of winning bets and collection of losing bets. After completing the payout and collection, the dealer will return dolly BD from the winning location on the table 100 to its resting spot DTSO, thereby deactivating all sensors except SS1 and SS2.

As shown more particularly in FIG. 5C, player sensor PS1 (Line 5) when energized will signal an alarm A2 as long as dealer trip contacts DT1 and DT2 (Line 5) are in their normal state, i.e. uninterrupted by the dealer. Similarly, player sensor PS2 (Line 6) when energized will signal an alarm A3 as long as dealer trip contacts DT1, DT2 and DT3 are in their normal state, and so forth down to Line 18 of the circuit diagram of FIG. 5C designating player sensor PS14, which when energized will signal an alarm A15 as long as dealer trip contacts DT11, DT12 and DT13 are in their normal state. The dealer through his/her normal activity during the payout and collection stage of the game will pass over the dealer trip sensors and take them out of their normal state.

For example, dealer trips sensor DTS1, Line 19 of FIG. 5D, when tripped by the dealer interacting with a player or customer in that area of the table, usually during payout or collection, will turn off or deactivate player security sensors PS1 and PS2 (see also Lines 5 and 6 of FIG. 5C) and such sensors will remain deactivated until dolly BD is positioned back on its resting location DTSO by the dealer (see also Line 20 of FIG. 5D). Dealer trips sensor DTS2, when tripped by the dealer interacting with a player in that area of the table, will deactivate player security sensors PS1, PS2 and PS3 (see Lines 5, 6 and 7 of FIG. 5C) and such sensors will remain deactivated until brass dolly BD is positioned back on its resting location DTSO by the dealer (see also Line 22 of FIG. 5D), and so forth down to Line 44 of circuit diagram FIG. 5D.

FIGS. 5B through 5D illustrate an alternative sensor arrangement to that described in connection with FIGS. 5 and 5A. Such alternative arrangement can, from the player perspective, be considered a more secure arrangement because each player is monitored individually during the play of the game. Depending on the particular desires of such casino, either arrangement may be successfully implemented, and the movement of the dealer during the normal play of game does not have to be modified depending on the selected arrangement. Of course, other sensor arrangements could be implemented in accordance with the spirit and scope of the present invention, and if desired, such systems could also incorporate non-conventional wagering locations such as "bonus spots" or the like as discussed above.

FIG. 6 is a diagrammatic plan view of a broken away section of a baccarat or mini-baccarat table, showing the interaction between a player, the table and a dealer 5. Baccarat and mini-baccarat differ in the number of players and who deals the cards. In mini-baccarat, the dealer handles all of the cards, which differs in some respects from baccarat, where the dealer may supervise the deal of the cards by one or more players at the table. As with the game of blackjack, the gaming table contains three locations of interest. The wager locations 30*x* in mini-baccarat are indicated by the separate designations "Tie", "Banker", and "Player", which are usually rectangular in form, while the player sensors 20*x* separate the wager locations 30*x* from the player locations 10*x*. Sometimes, the winning wager locations 30*x* may be illuminated, which may occur at all of the winning wager locations or only those locations that have bets positioned thereupon. The dealer location sensors 40*x* serve the same purpose in mini-baccarat as they do with the previously described blackjack embodiment. The interaction between the players and the dealer in either mini-baccarat or baccarat is similar to that in blackjack, where the dealer progresses around the table and elicits each individual player before moving on to the next. The control theory is therefore basically the same as with blackjack, i.e. the dealer will motion toward the player he or she is eliciting, thereby deactivating that player position and allowing the player to take some authorized action related to playing of the game, while the detectors associated with the remaining players to whom the dealer's attention is not directed remain activated to prevent unauthorized actions by such players.

One of the sensors of primary importance to the dealer 5 is sensor 400, which is activated when the dealer 5 distributes the cards, thereby energizing the entire table. Sensor 502 serves as the resting place for the unused deck once the cards have been dealt to the players, and once energized, activates all of the player sensors 20*x*. Sensor 800 covers the discard rack, which is activated when the dealer 5 clears the table of cards at the end of the round of play and serves to deactivate the entire table. One of the sensors 601, 602 and 603 are used to signal the winning wager location, i.e. PLAYER, BANKER or TIE, which thus may illuminate such winning wager location on the table. Of course, all these sensors are preferably located physically out of sight of the players, the dealers and any other observers. The most preferable location would be underneath the surface of a conventional table, although the sensors could also operate from above the table. Also, some of the devices operated by the dealer may be a sensor, a push button, a switch or other device that effects a momentary or permanent set or sets of electrical contacts. However, the locations would preferably be the same. If any of the player sensors 20*x* detect illegal movement, such will be brought to the attention of the casino via a suitable monitoring system 900

If no player activates their respective sensor, i.e. if no player decides to cheat, the game can progress. Dealer will pass over the correct sensor, either 601, 602 or 603, to indicate the winning wager locations, thereby lighting the correct PLAYER, BANKER or TIE rectangles with player wagers located thereon. Of course, in a manual operation, the dealer may illuminate the correct rectangles by hitting a switch, pushing a button, or the like. Also, during the payout and collection period, the dealer's hand motion must first pass over sensors 40*x* to collect or pay, which will send a signal to the system of the invention and deactivate the players's sensors one at a time or two at a time or by any number the casino deems necessary to insure that the dealer's vision will not be disrupted and no player can manipulate his or her wager. As dealer pays, usually from right to left, or in reverse order from the players elicited during the betting stage, thereby deactivating the players's sensors from right to left, such sensors will remain deactivated allowing players to pick up their winning wager or to make a new wager in anticipation of the next round or game. After the dealer pays out, he or she will pick up the playing cards and, upon discarding them in the discard rack, will trigger sensor 800 thereby deactivating the entire system. The system of the invention will remain deactivated until cards for the next game are placed in the area defined by sensor 502. Activating sensor 502 will energize the system, which will remain energized until the game is finished.

Figure 7:
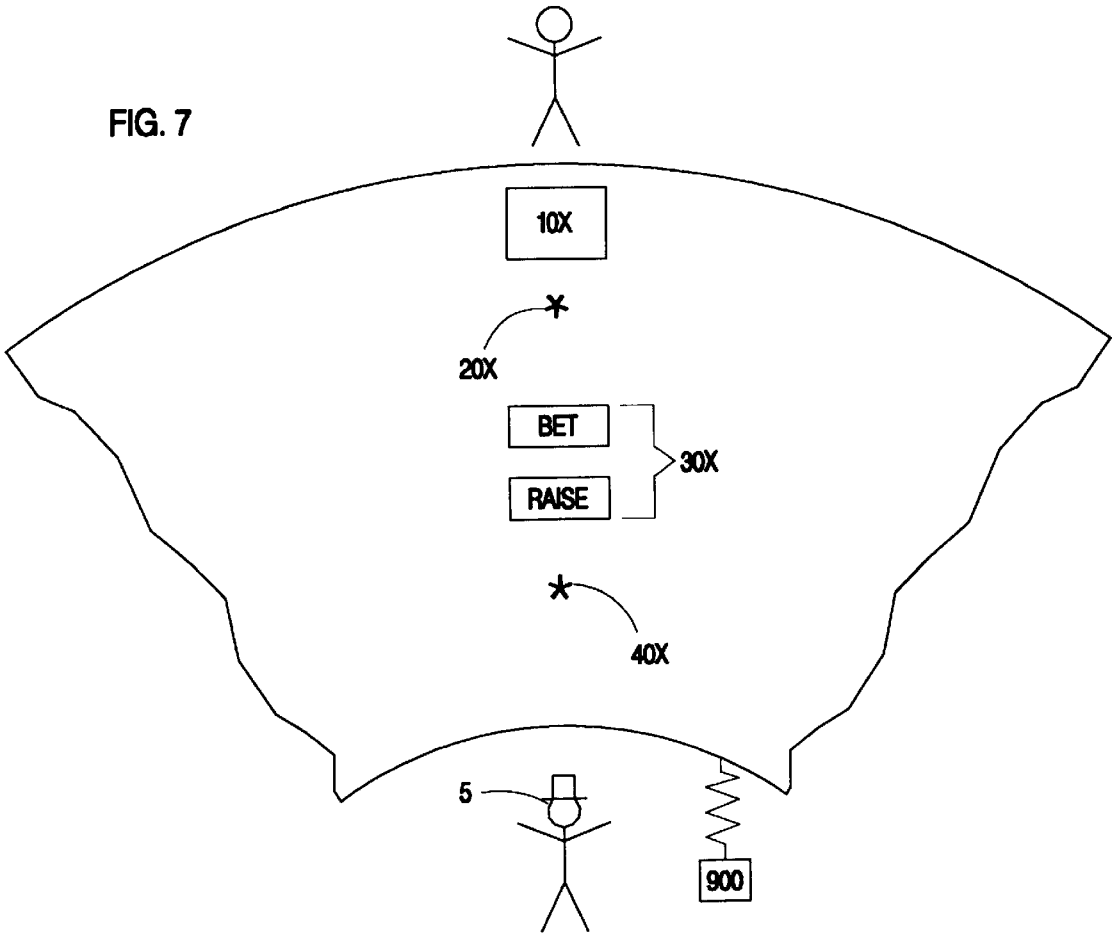
FIG. 7 is a diagrammatic plan view of an imaginary generalized upper surface of a casino game table for purposes of illustrating the device and the system of the invention while playing an "acey-deucy" type casino game.

FIG. 7 is an illustration of the device of the present invention applied to the casino game of "Acey-Deucy" (or sometimes known as "Red Dog."). As with FIGS. 2A and 6, only one player is highlighted to illustrate the table considerations which make Acey-Deucy different from Blackjack. In Acey-Deucy, the dealer turns over and separates two cards for all the players to view. Each player may then wager a certain amount, up to their original ante, as to whether the value of the dealer's next card will be in-between the values of the first two cards initially revealed. For example, if the dealer initially turns over a two and a king, there is a very good chance that the next card will be in-between a two and a king, for example, an eight. If the dealer's third card was an ace, then the dealer would win and each player would lose.

FIG. 7 illustrates the same player/dealer locations as seen in blackjack and mini-baccarat, where the player sensor 20*x* separates the player location 10*x* from the wagering location 30*x*, here shown as a "Bet" location and a "Raise" location. The dealer position sensor 40*x* determines the active player and the location of the eliciting dealer around the table.

Acey-Deucy has the possibility of obtaining two "tie" bets, where neither the dealer or the player wins. This occurs when either the first and second cards revealed by the dealer are a pair, in which case the chances of the third card revealed by the dealer being in-between the first and second cards in value is nonexistent. When a "pair" is showing, the third card is drawn, and if it makes a "three of a kind", then the player automatically wins eleven (11) times the original bet. If the card does not make "three of a kind", then a tie results and there is no winner and no loser.

In Acey Deucy, the incentive to cheat is the greatest when the value spread between the cards is great, or when a pair is drawn by the dealer. When the value spread is great, chances are good that the dealer will pick a third card that is in between the first two cards in value, and therefore a winner for the player. When a "pair" is drawn, a player is anticipating a big win if the dealer draws a third identically valued card, resulting in an eleven to one payoff. The control theory in producing a sensor system for Acey Deucy is relatively the same as with blackjack, with the only differences being as a result of the differences in interactive card variations between the two games. In other words, the dealer's display of the first two cards will activate the detection system, parts of which will be deactivated only when the dealer directs his attention to a particular player as appropriate.

Figure 8:
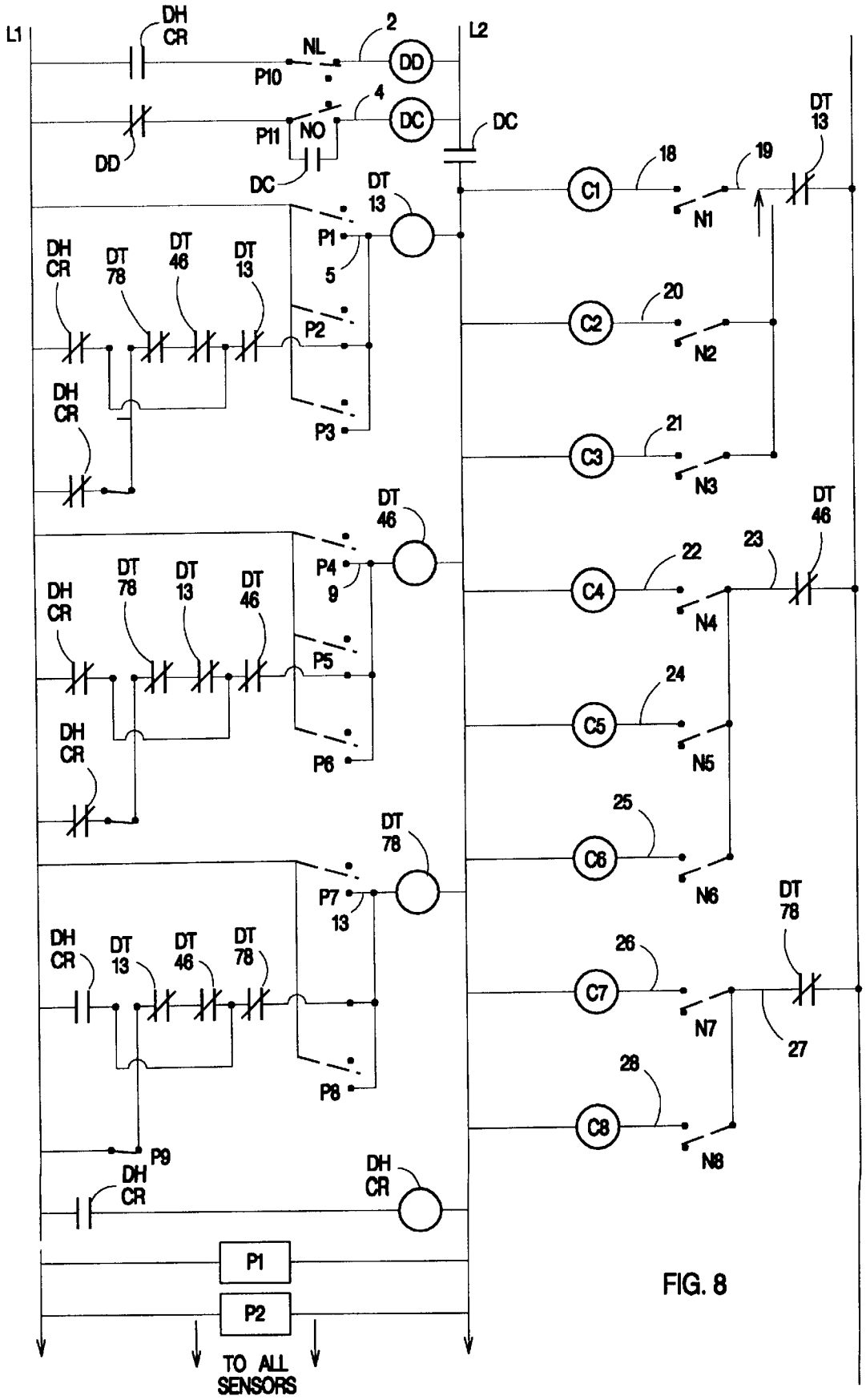
FIG. 8 is a circuit diagram an embodiment of the system of the invention as it is used with a blackjack type casino game table.

While various proximity detectors can be used in the cheating detection systems of the invention, as indicated above, a presently preferred system makes use of capacitative detectors. Such detectors can be linked in a system by an electronic circuit such as shown in FIG. 8 describing a blackjack table, in which the individual circuit elements have the characteristics shown in Table A. These electronic elements are electromechanical switches and the like. However, it will be understood that a completely solid state control system can be designed.

The wiring diagram of FIG. 8 demonstrates a control theory which contains three distinct groupings of players, namely players 1 through 3, 4 through 6, and players 7 and 8. These groupings are associated with the dealer trip relays DT13 (players 1 through 3), DT46 (players 4 through 6) and DT78 (players 7 and 8), which control the activation and deactivation of the player sensors N1 through N8. The present inventors have found that a wiring diagram incorporating these groupings of players is a sufficient way to demonstrate the effect of the invention without the production of an overcrowded wiring diagram. The number of relays and the type of control theory is limited only by the associated cost, and the present inventors do not intend to limit the design of the control structure to that of FIG. 8, but intends merely to demonstrate the operation of the invention in accordance with one particular control theory. A line by line recitation of FIG. 8 is found beginning at column 20,line 36,of U.S. Patent No. 5,831,527, and is incorporated herein by reference.

The sensors of the invention are physically located underneath the surface of a gaming table, and therefore the voltage must be high enough so that dirt and other incidental conditions would not impair the sensors's effectiveness. The sensitivity of the sensors, and therefore the scope and range of the sensing field, may be adjusted depending on the demands of the casino. The sensing field may encompass merely a single chip, or it may encompass a stack of fifteen chips. If the effective field is not large enough to accommodate a sizeable stack of chips, then a player would be able to add or subtract chips from the top of the stack, which would be above the range of the sensing field, without triggering the sensor. Obviously, the strength and range of a sensor's field will be directly related to the type of sensor used, and the amount of power required to effect that particular range and field. The present inventors have found that an effective sensor field of approximately two inches in height and diameter should be sufficient, although other effective fields are surely contemplated. All sensors generally operate between 10 and 65 VDC, and the present inventors chose 24 VDC because of the availability of associated equipment necessary to operate the device of the present invention, i.e. bulbs, contactors and power supplies.

Operation of the system of the present invention will obviously depend on the nature of the game and its respective sensor demands. A dealer usually initiates a round of play after all of the players have placed their initial wagers ("antes"), such wagers possibly including non-conventional wagers such as "bonus spot" wagers. If a bonus spot wager is involved, the dealer must take the necessary steps to prepare the table for a regular round of play, which might include locking a particular player's bonus spot wager into the table's tracking system with the push of a button, the flick of a switch or the like. If the table is equipped with a bonus spot sensor, then such sensor might automatically track the players that are participating in the bonus round, and a different sensor triggered by the dealer might lock such players into the bonus spot round, and at the same time lock out other players from participating after the game has begun. Of course, the dealer could also handle all bonus spot wagers manually with illuminated push buttons or the like.

The dealer then activates the table by starting the round of play. In blackjack and other card-based games, this occurs when the dealer distributes a hand of cards. Obviously, in non-card-based games such as roulette, this can occur by the spin of a wheel, the drop of a ball or the manipulation of a winning number indicator such as a brass dolly. There is always some triggering event that makes the table "hot" so to speak, and from such point, any interference with the wager location sensors or player sensors would cause a signal to be transmitted to casino personnel to alert such casino personnel to a breach in security.

The systematic dealer interaction with the players usually occurs during both the play of the game and the payout/collection period after the fate of the players's wagers has been determined. In general, the dealer addresses each participating player in turn, usually proceeding in a clockwise fashion around the table from the first player to the dealer's immediate left to the last player to the dealer's immediate right. Operation of the device of the present invention is not dependent on a full table of players, although the device of the present invention is intended to accommodate from a full table to merely one player.

The action of the dealer addressing a particular player at a table, or in other words the placement of the dealer's hand over a corresponding dealer sensor, will trigger the deactivation of all sensors associated with such player, so that the player and the dealer can physically interact without creating a security problem. Obviously, such player being directly elicited by the dealer would find it very difficult to cheat when such player has the dealer's full attention. When the dealer moves to the next player, the previously elicited player's sensor becomes re-activated, and the presently elicited player's sensors deactivate. If the control scheme provides for the grouping of players and sensors, then such sensors would activate and deactivate in groups as the case may be.

After the dealer has addressed each player in turn, and all of the players are satisfied with respect to their final positions and bets, the dealer performs another triggering event which effects the sensor positions of the entire table. For example, in blackjack this occurs when the dealer reveals his or her face-down card and plays out his hand. In roulette, this occurs when the ball lands in the winning slot and/or the dealer removes the dolly from its resting position for placement on the corresponding winning number on the roulette board. As the dealer finishes his/her hand if playing blackjack or the like, or terminates the round of play, usually focusing on a section of the table not associated with players wagers, all of the player sensors are operational or active, which is critical to the device of the present invention, since the dealer's focus is on his or her hand or the table in general, and not on the players or their respective wagers.

Once the fate of the players's wagers have been determined, the dealer must payout those players that won, and collect from those players that lost. The conventional way the dealer addresses each player during the payout and collection process is in reverse order to that of the normal betting and playing stage, i.e. starting with the last player with respect to the dealer and ending with the first player. As the dealer addresses each player in reverse order, he or she will deactivate each respective player sensor in order to pay out or collect from such player without triggering a security situation. Once each player has received his or her winnings, or lost his or her wager, there is no need for any further monitoring since such player's wager, which is now nonexistent, is no longer capable of being modified or altered.

After dealer pays or collects from each player, he or she will sweep all cards on the table into the discard rack, which results in the deactivation of the entire table. The table undergoes a reset and is now ready for a new round of play.

Any movement at or about any of the player sensors when such sensors are operational will activate an appropriate signal and alert a person or system at a remote location so that security personnel, or an alternative monitoring device, can have their attention directed to the table and/or player in question. The monitoring system of the present invention is dependent on the whims or desires of the casino implementing such system, and is not meant to be limited to one particular structure or monitoring arrangement. The alarm signals, for example, as previously discussed with respect to the monitoring system 900, can correlate to a visual, audible, computer generated monitoring display or system, or any other system decided upon by the casino.

The electronic circuit diagram and noted components of FIG. 8 constitute the presently preferred arrangement of Applicant's detection system for a blackjack-type casino table, but will be understood to be only one of a number of similar or related embodiments of the invention which can be constructed and to be illustrated as only one presently preferred embodiment for a single game, where the detection system of the invention is particularly useful.

Figure 9:
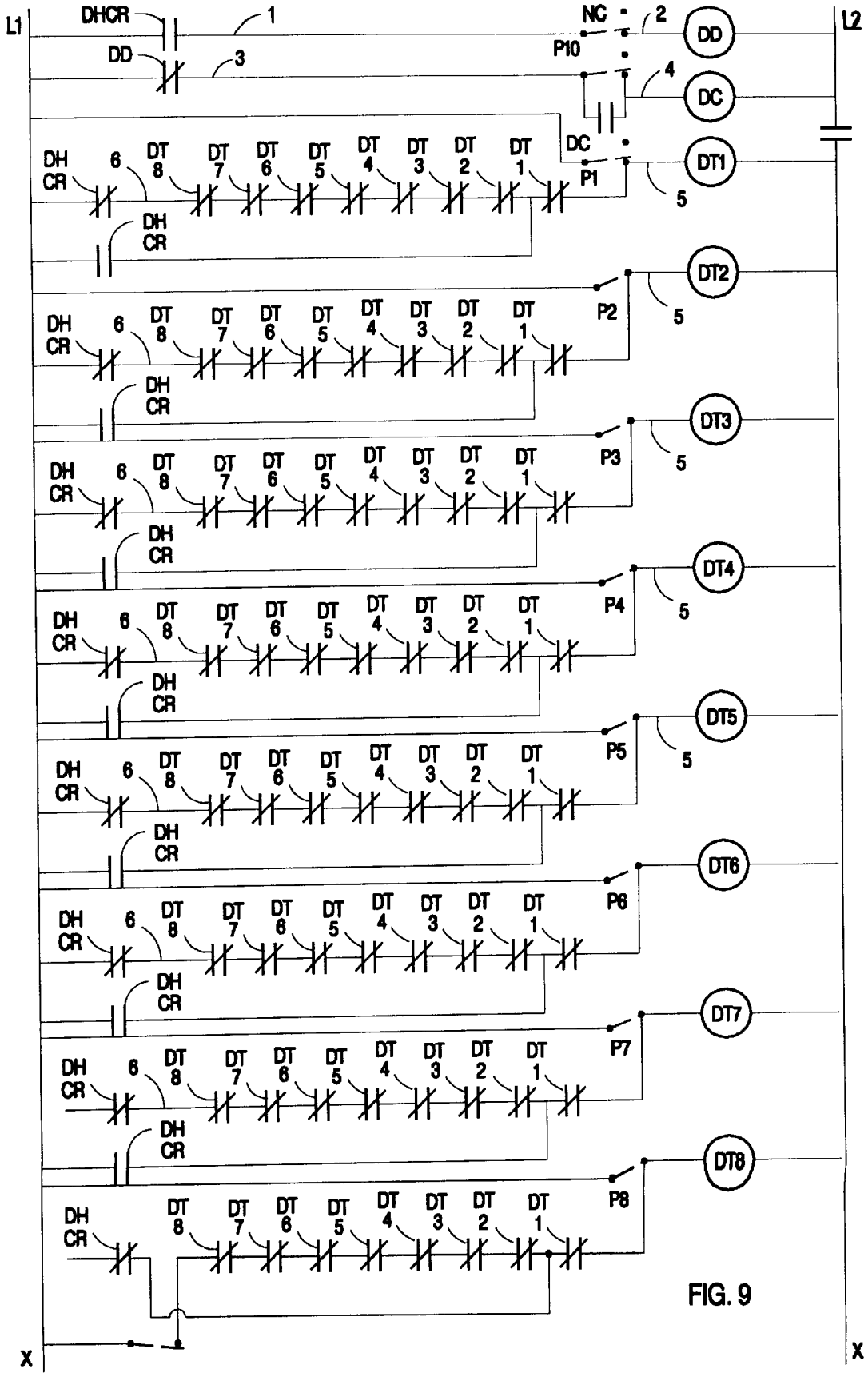
FIGS. 9 and 9A are a circuit diagram of an alternative embodiment of the system of the invention as it is used with a blackjack type casino game table.
Figure 9A:
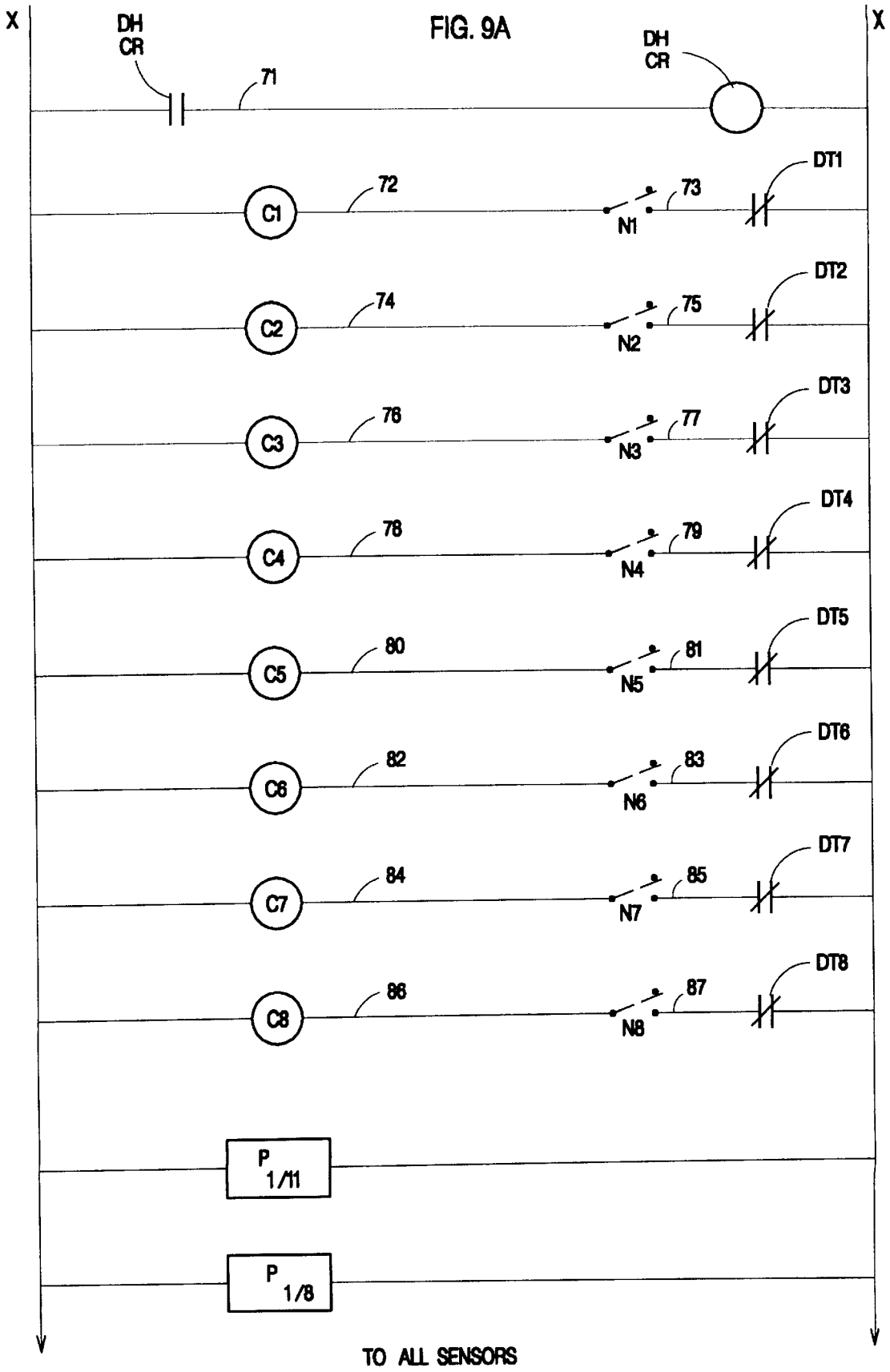

FIGS. 9 and 9A are a wiring diagram, similar to that of FIG. 8, of an embodiment of a system of the device of the present invention which operates on a control theory similar to that previously described in connection with the blackjack embodiment. Whereas FIG. 8 demonstrates sensor arrangements for three different groupings of players, namely players 1 through 3, 4 through 6, and 7 through 8, FIGS. 9 and 9A illustrate a sensor and relay location arrangement for each individual player. Whereas FIG. 8. has three relays for three groupings of players, namely DT13 for the first three players, DT46 for the second three players, and DT78 for the last two players, FIGS. 9 and 9A display a relay for each player, i.e. DT1 through DT8 while keeping the same dealer sensors and relays. FIGS. 9 and 9A illustrate a control theory whereby the dealer only renders that elicited player's sensor inoperable, which means that the dealer only has to focus on one player at a time as opposed to three players at a time. FIGS. 9 and 9A illustrate a system where the dealer doesn'st have to rely on his or her peripheral vision as much as with the system of FIG. 8, since the only player of concern is the player immediately being addressed or elicited by the dealer.

The present inventors realize, and others skilled in the art will also realize, that the different combinations of control theories with respect to the different number of player sensors and relays is too numerous to describe. FIGS. 8, 9 and 9A illustrate the wiring diagrams and electrical descriptions of only two control scenarios. An electronics engineer or technician will, by reference to these circuit diagrams, be readily able to provide an operating circuit in accordance with invention as diagrammed in FIGS. 8, 9 and 9A and Table A. The same applies for FIGS. 5C and 5D.

Figure 10:
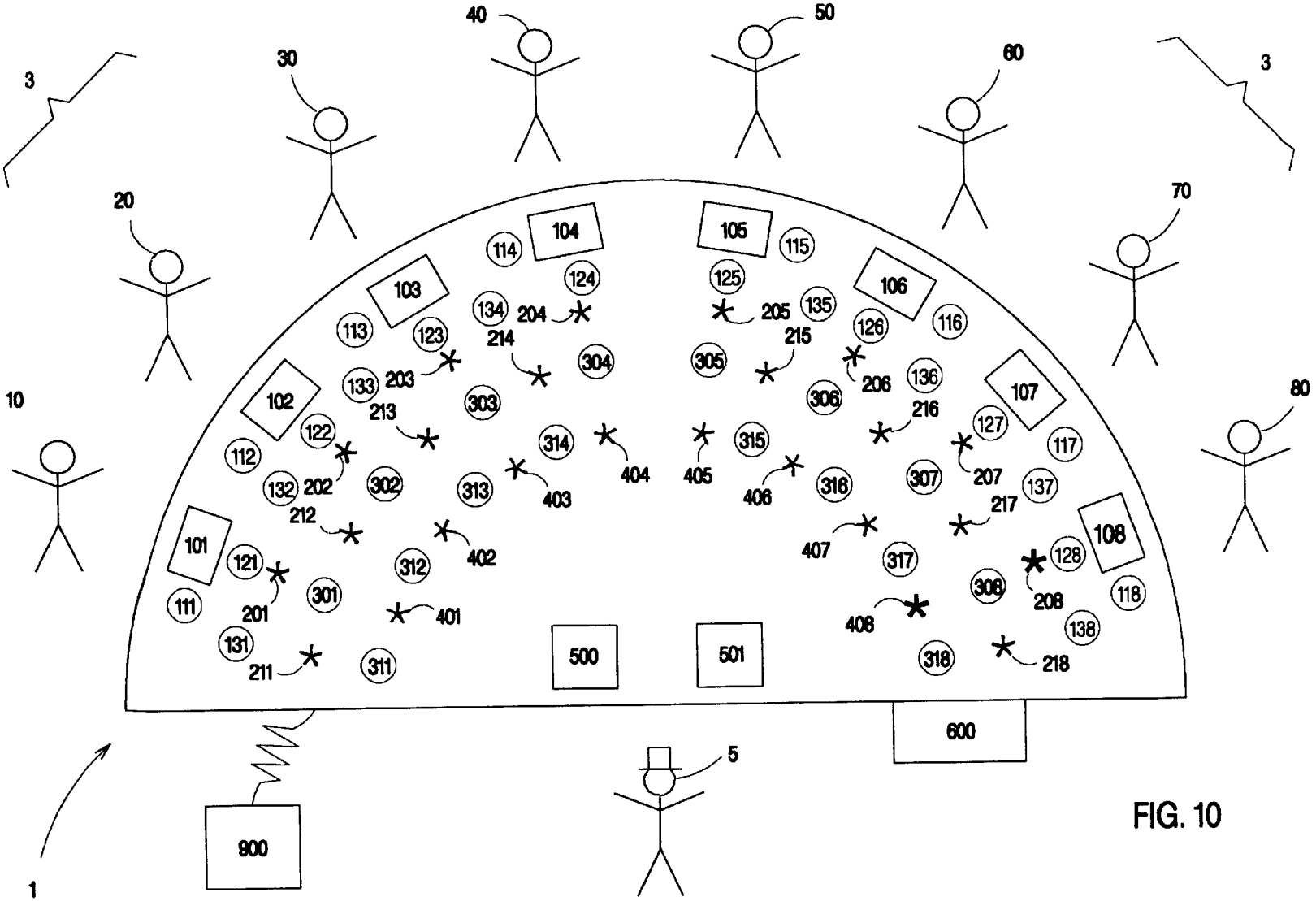
FIG. 10 is a diagrammatic plan view of an alternative embodiment of an imaginary generalized upper surface of a casino game table for purposes of illustrating the device and the system of the invention while playing a blackjack type casino game.

The monitoring and sensor system of the present invention can also be utilized, for example, in conjunction with other monitoring and sensor systems as shown in FIG. 10. The players 10 through 80 have associated with their positions the previously described player locations 10*x*, player sensors 20*x* and 21*x*, wagering locations 30*x* and 31*x* and dealer sensors 40*x*. The system of the invention could also utilize, for example, a player identification location 11*x*, i.e. locations 111,112,113,114,115, 116,117 and 118, in the form of a card reader which accepts a personal identification card having personal player information coded thereon, a fingerprint identification device capable of reading a player's fingerprint or some other personal characteristic such as an eye scan or the like, which location 11*x* could be implemented into the system of the invention and coordinated, for example, with the monitoring system 900 to record and track player wagers. Location 11*x* could also be utilized, for example, to determine which player sensors 20*x* and 21*x* should be activated during the round of play, and this could save energy alleviating the need to maintain the entire table active if less than all of the seats are occupied. Location 11*x* could also be utilized to warn the casino if a "high roller" is playing a particular game, or if the personal information reveals a player that consistently wins without ever being caught cheating. Consequently, location 11*x*, representing a personal identification information device or the like, could prove very useful in monitoring and tracking particular player activity for purposes of determining so-called "comp rewards" or the like. The personal identification devices could, if desired, be used to track, for example, each time a player tries to cheat, and the casino could code such information into the personal identification device to, for example, alert any subsequent dealer as to the cheating history of a particular player once that particular player visits a new table with his or her personal identification characteristics.

The system of the invention could also utilize visual tracking devices 12*x* locations 121, 122, 123, 124, 125, and 13*x* ,i.e. locations 131,132,132,133,134,135,137, and 138 situated near the wager locations 30*x* and 31*x*, described in connection with FIG. 2 which visually monitor the wager locations and, if desired by the casino, the wagers placed thereon. Such visual tracking devices 12*x* and 13*x* could, for example, take the form of cameras embedded in the casino gaming tables that are directed to the wager locations 30*x* and 31*x* and have the ability to determine the amount of the wager placed thereon by the number and color of the chips. Of course, these visual tracking devices could also be positioned apart from the surfaces of the actual casino tables, i.e. situated on the wall or ceiling adjacent the casino table or, for example, on a separate post-like object onto which is placed a camera or hidden camera or the like, such as a table marker or the like.

The visual tracking devices 12*x* and 13*x* could communicate player wagers and wagering activity directly to the casino, or indirectly via a personal information storage device such as a personal identification card or the like used with location 11*x*. The visual devices 12*x* and 13*x* could also, for example, be used to track player wagers at particular moments during the round of play, such moments being dictated or controlled, for example, by player and dealer movement about the table as triggered by sensors 20*x*, 40*x* or the like. For example, if a player wagers a certain amount at the beginning of the game, the act of the player crossing over, for example, sensor 20*x* to place his or her wager on location 30*x* would be communicated to the visual device 12*x* , which would, after all bets should have been placed, record the amount of the initially placed wager. If such wager is modified during dealer elicitation, the visual device 12*x* would then record the amount of modification and the amount of the revised wager. The visual monitoring systems could, for example, prevent an illegal modification, such as if a "double down" bet resulted in a tripled wager, and as noted above, such information can then be sent to the casino and/or the particular dealer at the table. Finally, at the end of the round, the visual device would confirm that the winning wager assessed by the dealer is actually the correct amount (the amount of the modified wager after dealer elicitation). Consequently, while the sensor system of the present invention was originally designed to detect movement about particular locations on a gaming table, enhancements to such sensor system could also result in the monitoring, detection and tracking of both movement and wagering activity, either independently or in conjunction with each other.

Another example of the implementation of a visual device monitor would be the use of the device 13*x* to monitor a bonus spot location 31*x*. If a player makes a bonus spot wager of, for example, $100, the visual device 13$x$ would record such amount after all the bonus spots should have been contributed, and if such bonus spot pays off, the visual device 13$x$ would compare the wager amount at the end of the game to the wager amount initially placed, and if such wager amount is different, such as, for example, $200, then the dealer knows that the player modified such wager during the play of the game. The visual device 12$x$ could be used, for example, to track the amount of the wager on a dealer screen (not shown) or the like, so the dealer does not have to remember the amount of the bonus wager at all times. The visual devices 12$x$ and 13$x$ could, therefore, act independently of, or in conjunction with, the player and dealer sensors 20$x$ and 40$x$, to create an incredibly secure environment capable of automatically tracking every movement, wager and wagering history for each player at a given table.

As will be recognized from the foregoing disclosure and appended drawings, the present invention provides an extremely useful and efficient system for detecting unauthorized moves and changes to their wagering by gamblers in casino games where large scale losses tend to occur due to such cheating by both casual and professional gamblers. The system of the invention not only is not normally detectable by the public in a casino, but is also not detectable by the dealers themselves, except inferentially, and even then, its exact operation and times of operation are not readily ascertainable by casino personnel, tending therefore to keep such personnel honest and, even more important, to inhibit their cooperation with organized crime figures and the like. The automatic operation, and particularly the undetectability of the system, tends to keep those who might otherwise be corruptible from being corrupted either by greed or by possible threats by others, who, realizing that a dealer, for example, may not be able to readily aid them to cheat, may be more likely not to threaten a dealer to win his or her cooperation.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

TABLE A

Reference to Figure 8 Control Circuit Diagram

| Reference Character | Description | Electrical Specification |
|---|---|---|
| DHCR | Dealer hole card | Electromagnetic |
| DD | Dealer discharge | relay with normally |
| DC | Dealer's first card | open and normally |
| DT13 | Dealer trip 1 through 3 | closed contacts |
| DT46 | Dealer trip 4 through 6 | |
| DT78 | Dealer trip 7 and 8 | |
| P1–P8 | Dealer positions 1 through 8 | Sensor |
| P9 | Dealer's hole card | |
| P10 | Dealer discharge | |
| P11 | Dealer first card | |
| C1–C8 | Signal indicator or generator (light, tone, etc.) | Signal |
| N1–N8 | Player positions 1 through 8 | Sensor |

What is claimed is:

1. An unauthorized movement detection system for casino tables comprising:

a. a movement detection device adjacent a dealer's position at a casino table to detect an activating movement of the dealer, b. movement detection devices adjacent at least one player position on the opposite side of the casino table from the dealer's position, c. said movement detection devices adjacent at least one player position and the dealer's position having the capability of detecting movement of both the player in a wagering location and the dealer adjacent each player, d. coordinating means linking the various detection devices such that movement at the dealer's position will activate or deactivate the various detection devices at least one player position to detect movement there adjacently, and e. means to provide a signal to an appropriate monitoring system when movement is detected at a player position while player detection devices are activated, f. the movement detection devices adjacent at least one player position being of two kinds, one detecting movement of the of the players and one detecting movement of the dealer, and wherein the detectors detecting movement of the dealer are arranged to activate or deactivate the detectors for detecting movement of the players, g. wherein the wagering location wherein the wagering location can further comprise a non-conventional wager location to accommodate a wager separate from a wager made during a normal round of play, and such non-conventional wager location is accessed prior to the beginning of play and the detection system is hidden from view.

2. An unauthorized movement detection system for casino tables in accordance with claim 1 further comprising personal identification detection devices for monitoring and tracking the wagering history of casino table participants.

3. A cheating detection system for a casino table comprising:

a. a plurality of movement detectors associated with the casino table, b. the detectors being positioned to detect movement at the surface of said casino table in a patterned sequence such that unauthorized movement is detected, and c. means to signal unauthorized movement detected by the detectors to a casino monitoring system, d. the detectors being are associated with both player positions and dealers positions at said table, e. there being a first set of detectors adjacent the players for detecting movement of the players and a second set of detectors adjacent the players on the dealer's side for detecting movement of the dealer, f. the second set of detectors being arranged to activate or deactivate the corresponding first set of detectors upon an address movement of the dealer, and g. a plurality of visual detectors positioned to detect player wagers in coordination with said movement detectors.

4. A method of detecting cheating at casino tables comprising:

a. detecting movement adjoining the table top adjacent player positions during play at certain positions, b. determining whether such detected movement is dealer movement or player movement, c. using dealer detected movement to activate or deactivate player movement detectors, and d. signalling player movement detected by activated player detectors to a monitoring system, e. dealer movement being detected between the players and the dealer by capacitance-type detector apparatus, f. player movement being detected between the player and player bet positions on the casino table, and g. further monitoring the wager locations in accordance with movement detected adjacent player positions to ensure the accuracy of the dealer payout at the end of the round of play.

5. An unauthorized movement detection system for maintaining gaming table security comprising:

a. a movement detection device adjacent at least one player position at a casino table having a detection field encompassing at least a portion of a betting zone on the table for such at least one player, b. an activation device at another location adjacent the table surface to activate the movement detection device, and c. a monitoring system to indicate to security personnel when the activated detection device has detected unauthorized movement.

6. An unauthorized movement detection system in accordance with claim 5 wherein the activation device is a movement detection device adapted to operate a circuit to activate the movement detector device in response to standardized movement adjacent the gaming table.

7. An unauthorized movement detection system in accordance with claim 6 wherein the activation device is positioned to detect movement in connection with the termination of a previous game at the table.

8. An unauthorized movement detection system in accordance with claim 7 wherein the activation device is positioned to detect movement of the player.

9. An unauthorized movement detection system in accordance with claim 6 wherein the activation device is positioned to detect movement of a dealer at the beginning of play.

10. An unauthorized movement detection system in accordance with claim 9 wherein the activation device is a field-type movement detection device.

11. An unauthorized movement detection system in accordance with claim 9 wherein the activation device is in the form of a body-activated switch arranged to be activated by the dealer.

12. An unauthorized movement detection system in accordance with claim 5 wherein there is within the betting zone on the table both a normal bet placement position and a bonus bet position.

13. An unauthorized movement detection system in accordance with claim 12 wherein there are two separate motion detection devices for monitoring the bet placement position and the bonus bet position.

14. An unauthorized movement detection system in accordance with claim 13 wherein a single motion detection device is provided to monitor both the normal bet position and the bonus bet position.

15. An unauthorized movement detection system in accordance with claim 13 wherein only the bonus bet position is monitored with a movement detection device.

16. An unauthorized movement detection system in accordance with claim 15 wherein the activation device is in the form of a body activated switch arranged to be activated by the dealer.

17. An unauthorized movement detection system for casino tables comprising:

a. a movement detection device adjacent a dealer's position at a casino table to detect an activating movement of the dealer, b. movement detection devices adjacent at least one player position on the opposite side of the casino table from the dealer's position, c. said movement detection devices adjacent at least one player position and the dealer's position having the capability of detecting movement of both the player in a wagering location and the dealer adjacent each player, d. coordinating means linking the various detection devices such that movement at the dealer's position will activate or deactivate the various detection devices at least one player position to detect movement there adjacently, and e. means to provide a signal to an appropriate monitoring system when movement is detected at a player position while player detection devices are activated, and f. personal identification devices for monitoring and tracking the wagering history of casino table participants.

18. An authorized movement detection system for casino tables in accordance with claim 17 further comprising visual detection devices for monitoring and tracking the wager amounts of casino table participants.

* * * * *